US007983597B2

(12) United States Patent
Kikuchi

(10) Patent No.: US 7,983,597 B2
(45) Date of Patent: Jul. 19, 2011

(54) COLOR ELECTROPHOTOGRAPHIC IMAGE FORMING APPARATUS WITH GRIPPING PORTIONS FOR CARTRIDGES

(75) Inventor: Ken Kikuchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 230 days.

(21) Appl. No.: 12/348,567

(22) Filed: Jan. 5, 2009

(65) Prior Publication Data

US 2010/0135691 A1 Jun. 3, 2010

(30) Foreign Application Priority Data

Dec. 2, 2008 (JP) ..... 2008-307380

(51) Int. Cl.
*G03G 21/16* (2006.01)

(52) U.S. Cl. ..... 399/111; 399/107; 399/119

(58) Field of Classification Search ..... 399/107, 399/111, 119
See application file for complete search history.

(56) References Cited

U.S. PATENT DOCUMENTS 6,735,405 B2 5/2004 Yokoi et al. ..... 399/109
6,832,057 B2 12/2004 Oguma et al. ..... 399/27
6,934,489 B2 8/2005 Yokomori et al. ..... 399/111
6,952,544 B2 10/2005 Kikuchi et al. ..... 399/109
7,073,251 B2 7/2006 Kikuchi et al. ..... 29/729
7,079,787 B2 7/2006 Ogino et al. ..... 399/111
7,296,341 B2 11/2007 Kikuchi et al. ..... 29/729
2005/0169665 A1* 8/2005 Okamoto ..... 399/111
2005/0238384 A1* 10/2005 Sampe et al. ..... 399/111

* cited by examiner

*Primary Examiner* — Ryan D Walsh

(74) *Attorney, Agent, or Firm* — Fitzpatrick, Cella, Harper & Scinto

(57) ABSTRACT

A color electrophotographic image forming apparatus having an apparatus main body to which a plurality of cartridges are detachably mounted adjacently in one direction for forming a color image on a recording medium, wherein each of the plurality of cartridges has a gripping portion disposed on a rear end of the corresponding cartridge in a mounting direction in which the cartridge is mounted to the apparatus main body, the gripping portion being protruding from the rear end to an upstream side, wherein when the corresponding cartridge is mounted to and detached from the apparatus main body, a user grips the gripping portion, and wherein in a state in which the plurality of cartridges are mounted to the apparatus main body, at least one gripping portion is disposed out of line with a gripping portion of an adjacent cartridge in a direction orthogonal to the mounting direction.

12 Claims, 23 Drawing Sheets

COLOR ELECTROPHOTOGRAPHIC IMAGE FORMING APPARATUS WITH GRIPPING PORTIONS FOR CARTRIDGES

BACKGROUND OF THE INVENTION

1. Field of the Invention

The present invention relates to a color electrophotographic image forming apparatus in which a plurality of cartridges are detachably mounted to an apparatus main body, thereby forming an image on a recording medium.

In this case, the color electrophotographic image forming apparatus is a type in which a color image is formed on the recording medium by using an electrophotographic image forming process. Examples of the color electrophotographic image forming apparatus include a color electrophotographic copying machine, a color electrophotographic printer (e.g., color laser beam printer and color LED printer), a color facsimile apparatus, and a color word processor.

The recording medium is a type on which an image is formed by an electrophotographic image forming apparatus, and includes, for example, paper and an OHP sheet.

A cartridge is, for example, a process cartridge or a developing cartridge, which is detachably mounted to a main body of the electrophotographic image forming apparatus and contributes to an image forming process for forming the image on the recording medium. In this case, the process cartridge is constituted as a cartridge in which at least one of a charging means, a developing means, and a cleaning means, which serve as a process means, is formed integrally with an electrophotographic photosensitive drum, and in which the thus formed cartridge is detachably mounted to the main body of the electrophotographic image forming apparatus. Therefore, the process cartridge includes one which is constituted as a cartridge in which the developing means serving as the process means is formed integrally with the electrophotographic photosensitive drum, and in which the thus formed cartridge is detachably mounted to the main body of the electrophotographic image forming apparatus. Further, the process cartridge includes one which is constituted as a cartridge in which the charging means, the developing means, or the cleaning means serving as the process means are formed integrally with the electrophotographic photosensitive drum, and in which the thus formed cartridge is detachably mounted to the main body. Note that, the process cartridge which includes the electrophotographic photosensitive drum and the developing means formed integrally with each other is referred to as a so-called integral type. Further, the process cartridge which includes the electrophotographic photosensitive drum and the process means other than the developing means formed integrally with each other is referred to as a so-called separate type.

In this case, in the process cartridge, the user himself/herself may perform mounting and detaching operation with respect to the image forming apparatus main body. Thus, the user may easily perform maintenance for the apparatus main body. Note that, the process means acts on the electrophotographic photosensitive drum.

Further, the developing cartridge includes a developing roller, contains developer (toner) which is used for developing an electrostatic latent image formed on the electrophotographic photosensitive drum by the developing roller, and is detachably mounted to the main body. Note that, in a case of the developing cartridge, the electrophotographic photosensitive drum is attached to the apparatus main body. Alternatively, the electrophotographic photosensitive drum is provided in the so-called separate type process cartridge (in this case, the process cartridge does not include the developing means). Note that, also, the user himself/herself may perform mounting and detaching operation of the developing cartridge with respect to the image forming apparatus main body. Thus, the user may easily perform maintenance for the apparatus main body.

Thus, the cartridge includes the so-called integral type or the so-called separate type process cartridge. Further, the cartridge includes one in which the so-called separate type process cartridge and the developing cartridge are used in a pair. Further, the cartridge includes one in which the electrophotographic photosensitive drum is attached to the apparatus main body, and in which the developing cartridge is used so as to be capable of acting on the electrophotographic photosensitive drum and to be detachably mountable.

2. Description of the Related Art

In the above-mentioned cartridge system, the user himself/herself performs an operation for mounting the cartridge to the apparatus main body, and an operation for replacing the cartridge when the cartridge outlives its usefulness. Thus, gripping portions are provided on a part of the cartridge in some cases so that the user may reliably hold the cartridge when handling the cartridge (U.S. Pat. No. 6,934,489).

According to U.S. Pat. No. 6,934,489, when mounting the cartridge to the apparatus main body, the user grips a gripping portion protruding from a frame of the cartridge, and inserts the cartridge into the apparatus along a guide portion of the apparatus main body. When detaching the cartridge from the apparatus main body, the user also grips the gripping portion to take out the cartridge to an exterior of the apparatus.

As described above, by providing the gripping portion on the cartridge, the user may easily perform mounting and detaching operation of the cartridge with respect to the apparatus main body.

On the other hand, in recent years, it has been necessary to reduce a height of the apparatus main body, or to reduce a size of the apparatus main body in a width direction in accordance with downsizing of the image forming apparatus. In accordance with this necessity, in the image forming apparatus using a plurality of cartridges, it is expected that distances between the mounted cartridges are made to be narrow, or that the cartridges are made to be thinner.

In the conventional structure, when an attempt is made to reduce the height of the apparatus main body more than that of a conventional one, it is expected that the distances between the cartridges mounted to the apparatus main body become narrow, and that distances between the gripping portions of the cartridges are also made to be narrow. Thus, even in a case of the structure as described above, it is desirable to achieve the structure for the user to easily grip.

SUMMARY OF THE INVENTION

An object of the present invention is to provide a color electrophotographic image forming apparatus including a plurality of cartridges adjacently mounted to an apparatus main body, in which gripping portions provided to the cartridges are easily gripped by a user.

Another object of the present invention is to provide the color electrophotographic image forming apparatus including the plurality of cartridges adjacently mounted to the apparatus main body, in which an operability when the user mounts and detaches the cartridges to and from the apparatus main body is improved.

Still another object of the present invention is to provide the color electrophotographic image forming apparatus in which a mounting and detaching operability of the cartridges is improved even when the user may not insert his/her hand for gripping the cartridges because the adjacent cartridges have narrow intervals therebetween in a state of being mounted to the apparatus main body.

As representative structure of an image forming apparatus according to the present invention for achieving the above-mentioned object, there is provided a color electrophotographic image forming apparatus that forms a color image on a recording medium in such a state that a plurality of cartridges are detachably mounted adjacently in one direction with respect to an apparatus main body of the color electrophotographic image forming apparatus, wherein each of the plurality of cartridges is disposed on a rear end side of the cartridges in a direction for mounting the cartridges to the apparatus main body, protrudes from the rear end side toward an upstream side, and comprises a gripping portion which is gripped by a user when the cartridge is mounted to and detached from the apparatus main body, and in which at least one of the gripping portions is disposed out of line with gripping portions of adjacent cartridges in a direction orthogonal to the mounting direction in such a state that the plurality of cartridges are mounted to the apparatus main body.

According to the present invention, it is possible to provide the color electrophotographic image forming apparatus including the plurality of cartridges adjacently mounted to the apparatus main body, in which the gripping portions provided to the cartridges are easily gripped by the user.

According to the present invention, it is possible to provide the color electrophotographic image forming apparatus including the plurality of cartridges adjacently mounted to the apparatus main body, in which the operability when the user mounts and detaches the cartridges to and from the apparatus main body is improved.

According to the present invention, it is possible to provide the color electrophotographic image forming apparatus in which the mounting and detaching operability of the cartridges is improved even when the user may not insert his/her hand for gripping the cartridges because the adjacent cartridges have narrow intervals therebetween in the state of being mounted to the apparatus main body.

Further features of the present invention will become apparent from the following description of exemplary embodiments with reference to the accompanying drawings.

DESCRIPTION OF THE EMBODIMENTS

Hereinafter, embodiments of the present invention are described in detail with reference to the drawings. Note that, the scope of the present invention is not limited to dimensions, materials, shapes, relative arrangements, and the like of components described in the embodiments if not otherwise specified.

First Embodiment

Figure 1A:
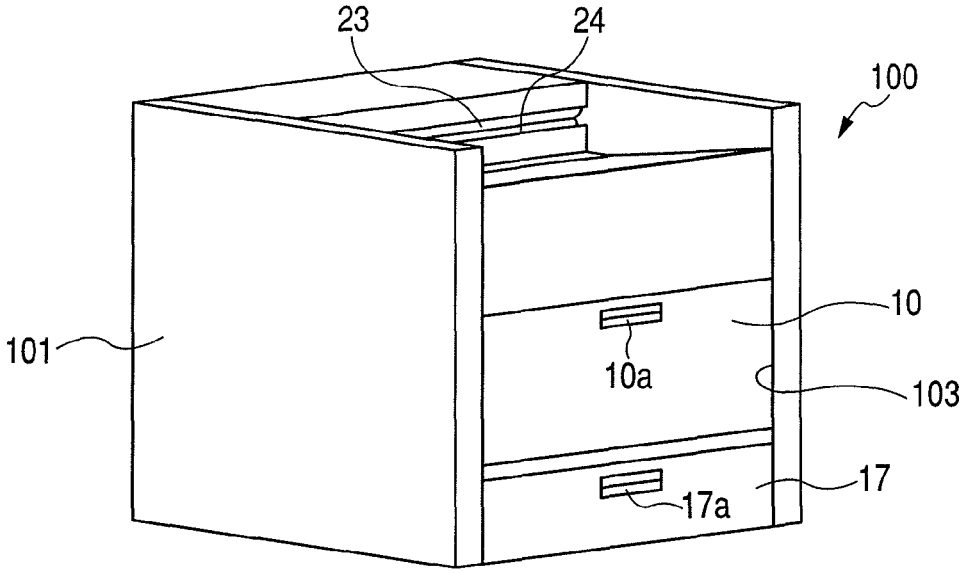
FIG. 1A is an external perspective view of an image forming apparatus according to a first embodiment.
Figure 1B:
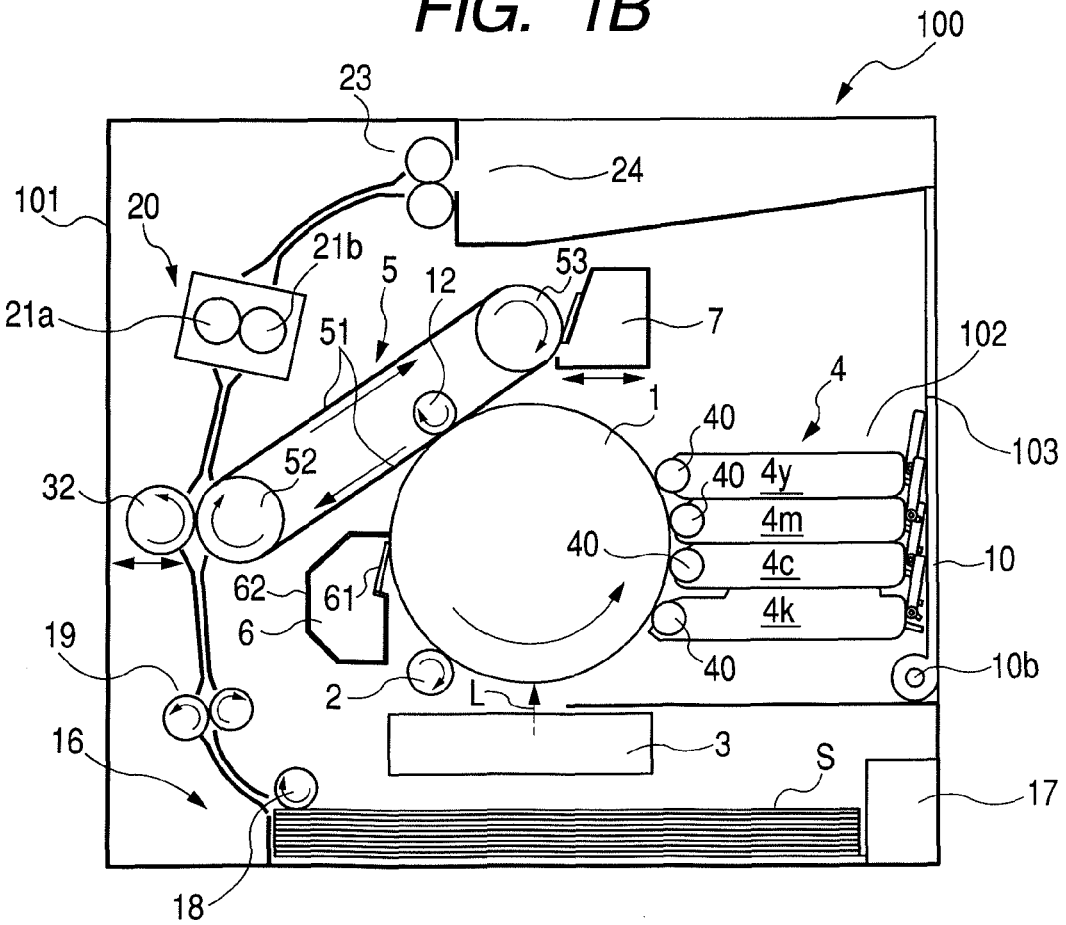
FIG. 1B is a right-side-schematic sectional view of the image forming apparatus according to the first embodiment.

General Schematic Structure of Color Electrophotographic Image Forming Apparatus FIGS. 1A and 1B are an external perspective view and a right-side-schematic sectional view, respectively, of a color electrophotographic image forming apparatus (hereinafter, referred to as image forming apparatus) 100 according to this embodiment. The image forming apparatus 100 is a four-full-color laser printer using an electrophotographic process. That is, the image forming apparatus 100 conducts an image formation with respect to a sheet-like recording medium S on the basis of an electrical image signal input from a host apparatus (not shown) such as a personal computer, an image reader, a facsimile on the other side, and the like to a control circuit portion (not shown). The image forming apparatus 100 described in this embodiment is a color electrophotographic image forming apparatus forming a color image on the recording medium S with a plurality of cartridges (4*y*, 4*m*, 4*c* and 4*k*) being detachably mounted adjacently in one direction, that is, a perpendicular direction (vertical direction).

In the following description, regarding the image forming apparatus, a forward side or a front side refers to a side on which a door 10 for opening and closing the apparatus is arranged. A rear side refers to an opposite side thereto. A front-and-rear direction refers to a direction from the rear side toward the front side of the image forming apparatus (forward direction), and an opposite direction thereto (backward direction). Left and right refer to left and right as looking from the front side of the image forming apparatus. A lateral direction refers to a direction from right toward left (left-hand direction) and an opposite direction thereto (right-hand direction). Further, an apparatus main body refers to an image forming apparatus portion excluding the cartridges.

In a substantially center of an apparatus main body 101, there is arranged an electrophotographic photosensitive drum 1 (hereinafter, referred to as drum) serving as an image bearing member on which a latent image is formed. The drum 1 is driven to rotate counterclockwise as indicated by an arrow. Around the drum 1, there are disposed, along a drum rotating direction, a charging means 2, a developing means 4, and a drum cleaning means 6 which serve as a process means acting on the drum, in order of mention. In addition, an image exposing means 3 and an intermediate transferring means 5 are disposed.

The drum 1 is obtained, for example, by coating an outer peripheral surface of an aluminum cylinder with an organic photoconductive layer (OPC photoconductor), and both end portions thereof are rotatably supported by right and left supporting members (not shown) on the apparatus main body side with a drum axis being in the lateral direction. Further, on one drum end portion, there is disposed a drive transmitting means (not shown) for receiving a driving force from a driving motor (not shown). The driving force is transmitted by the drive transmitting means. As a result, the drum 1 rotates counterclockwise as indicated by the arrow at a predetermined speed.

The charging means (process means) 2 in this embodiment is a contact charging type, and a contact charging member is a charging roller (conductive roller) formed into a roller shape. The charging roller 2 is arranged while being substantially in parallel to and abutting the drum 1, and driven by the rotation of the drum 1 to be rotated. Further, when a predetermined charging bias voltage is applied to the charging roller 2 from a power supply part (not shown), the surface of the drum 1 is uniformly charged to be a predetermined polarity and electric potential.

In this embodiment, the image exposing means 3 is a laser scanner unit, and arranged at a lower position of the drum 1. The unit 3 includes a laser diode, a polygon mirror, an Fθ lens, a reflection mirror, and the like, and outputs a laser beam L which has been modulated in correspondence to image information of each color, which is input from the host apparatus to the control circuit portion, thereby scans and exposes a charge treatment surface of the drum 1. As a result, an electrostatic latent image which corresponds to a scanning and exposing pattern is formed in the surface of the drum 1.

The developing means (process means) 4 is a device which visualizes the electrostatic latent image formed on the drum 1 with use of toner serving as a developer. In this embodiment, as a plurality of developing means, first to fourth, i.e., four developing devices 4 (4*y*, 4*m*, 4*c* and 4*k*) which contain toners having different colors are disposed between the drum 1 and the door 10 while being adjacent to each other in a vertical direction. Each of the developing devices 4*y*, 4*m*, 4*c* and 4*k* is a developing cartridge (hereinafter, referred to as a cartridge) which is detachably mounted to a cartridge mounting portion 102 of the apparatus main body 101. That is, each of the developing cartridges 4 includes a developing roller 40 and a toner containing portion 4*t* which contains the toner used in development of the electrostatic latent image by the developing roller 40. The developing cartridges 4 are detachably mounted to the apparatus main body 101 by a user.

The first cartridge 4*y* contains a toner of yellow color (y-color) as the developer. The cartridge 4*y* is hereinafter referred to as a yellow cartridge. The second cartridge 4*m* contains a toner of magenta color (m-color) as the developer. The cartridge 4*m* is hereinafter referred to as a magenta cartridge. The third cartridge 4*c* contains a toner of cyan color (c-color) as the developer. The cartridge 4*c* is hereinafter referred to as a cyan cartridge. The fourth cartridge 4*k* contains a toner of black color (k-color) as the developer. The cartridge 4*k* is hereinafter referred to as a black cartridge.

Each of the cartridges 4 includes a developing roller 40 which supplies the toner to the drum 1. Further, each of the cartridges 4 includes, though not shown in the drawings, a toner applying member which applies the toner to the developing roller 40, a developing blade which regulates a layer thickness of the applied toner and imparts an electrical charge to the toner, a toner agitating and carrying member, and the like.

The four cartridges 4*y*, 4*m*, 4*c*, and 4*k* are selectively developing-operation-controlled, and develop the electrostatic latent image formed on the drum 1. That is, in the selected cartridge, the developing roller 40 and the like are driven, and a predetermined developing bias is applied to the developing roller 40 from a power supply part (not shown). As a result, the development of the electrostatic latent image formed on the drum 1 is performed by the cartridge. That is, the development of the electrostatic latent image is performed by the developing roller 40 with use of the toner.

In this embodiment, the black cartridge 4*k* has a toner capacity larger than that of other cartridges 4*y*, 4*m*, and 4*c*. This is because the black toner is used very often, and hence a toner-containing amount is increased only in the black cartridge 4*k*.

The intermediate transferring means 5 in this embodiment is an intermediate transfer belt unit. This unit 5 includes an endless intermediate transfer belt (hereinafter, referred to as a belt) 51 serving as an intermediate transfer means, which is made of a dielectric body and having flexibility. Further, the intermediate transferring means 5 includes a first roller 52 and a second roller 53 around which the belt 51 is stretched, and a primary transferring roller 12 which is disposed between the first roller 52 and the second roller 53 and is pressed against the drum 1 with the belt 51 being interposed between the primary transferring roller 12 and the drum 1. A contact portion between the drum 1 and the belt 51 constitutes a primary transfer nip portion.

A secondary transferring roller 32 is arranged at the belt wrapped portion of the first roller 52 with being opposed thereto. The secondary transferring roller 32 is switchingly moved, by a movement mechanism (not shown), between an operative position of being pressed against the first roller 52 with interposing the belt 51 between the secondary transferring roller 32 and the first roller 52, and an inoperative position of being separated from the belt 51. The secondary transferring roller 32 is usually held at the inoperative position, and moved to the operative position at predetermined control timing. In such a state that the secondary transferring roller 32 is moved to the operative position, a contact portion between the secondary transferring roller 32 and the belt 51 constitutes a secondary transfer nip portion.

At the belt wrapped portion of the second roller 53, there is arranged a belt cleaning means 7 which performs cleaning of a surface of the belt 51. The belt cleaning means 7 is switchingly moved, by a movement mechanism (not shown), between an operative position at which a cleaning member is brought into contact with the surface of the belt 51, and an inoperative position at which the cleaning member is separated from the surface of the belt 51. The belt cleaning means 7 is usually held at the inoperative position, and moved to the operative position at predetermined control timing.

The drum cleaning means (process means) 6 is means that removes a primary transfer residual toner from a drum 1 surface after the toner image is primarily transferred to the belt 51, and a cleaning blade 61 is used as the cleaning member in this embodiment. The toner removed from the drum surface is contained in a cleaner container 62.

The control circuit portion drives a main motor (not shown) when an image formation start signal is input thereto. As a result, the drum 1 is driven to be rotated at a predetermined speed. Further, the belt 51 is also driven to be rotated in a forward direction with respect to a rotation direction of the drum 1 and at a speed corresponding to the speed of the drum 1. The secondary transferring roller 32 and the belt cleaning means 7 are moved to and held at the inoperative positions of being separated from the belt 51. The predetermined charging bias is applied to the charging roller 2. As a result, the surface of the rotating drum 1 is uniformly charged to be the predetermined polarity and electric potential. The laser beam L which has been modulated in correspondence to a y-color component image signal of a full-color image, is output from a laser scanner unit 3, whereby the drum surface is scanned and exposed. As a result, the electrostatic latent image which corresponds to the y-color component image is formed on the drum surface. The electrostatic latent image is developed as the toner image of y-color (developer image) by the development-operation-controlled yellow cartridge 4*y*. The toner image of y-color is primarily transferred on the surface of the belt 51 at the primary transfer nip portion. The primary transfer bias having a polarity opposite to the charging polarity of the toner and a predetermined electrical potential is applied from the power supply part (not shown) to the primary transfer roller 12 at the predetermined control timing. The cleaning is performed on the surface of the drum 1 after the primary transfer by the drum cleaning means 6.

When the primary transfer of the toner image of y-color with respect to the belt 51 is completed, there are conducted charging, exposing and developing processes for forming, with respect to the drum 1, a toner image of m-color corresponding to an m-color component image of the full-color image. The toner image of m-color is superimposed on the toner image of y-color which has been already transferred on the belt 51 at the primary transfer nip portion in a predetermined registration state, thereby being primary-transferred.

When the primary transfer of the toner image of m-color with respect to the belt 51 is completed, there are conducted charging, exposing, and developing processes for forming, with respect to the drum 1, a toner image of c-color corresponding to a c-color component image of the full-color image. The toner image of c-color is superimposed on the toner image of the y-color+the toner image of m-color which have been already transferred on the belt 51 at the primary transfer nip portion in a predetermined registration state, thereby being primary-transferred.

When the primary transfer of the toner image of c-color with respect to the belt 51 is completed, there are conducted charging, exposing, and developing processes for forming, with respect to the drum 1, a toner image of k-color corresponding to a k-color component image of the full-color image. The toner image of k-color is superimposed on the toner image of y-color+the toner image of m-color+the toner image of c-color which have been already transferred on the belt 51 at the primary transfer nip portion in a predetermined registration state, thereby being primary-transferred.

In this manner, unfixed four-full-color toner images of y-color+m-color+c-color+k-color are synthesized and formed on the belt 51.

Note that, a color order of the color toner images sequentially formed with respect to the drum 1 is not limited to the color order of y-color, m-color, c-color, and k-color as in the case of this embodiment, and may be an appropriate color order.

Before an image leading end portion of the unfixed four-full-color toner images formed on the belt 51 reaches a position of the secondary transfer roller 32 by the movement of the belt 51, the secondary transfer roller 32 is moved to the operative position at which the secondary transfer roller 32 is brought into contact with the belt 51. Further, the belt cleaning means 7 is also moved to the operative position with respect to the belt 51 at the predetermined control timing.

On the other hand, a feeding roller 18 of a feeding portion 16 is driven at the predetermined control timing, and one sheet of recording medium S is separated and fed from a cassette 17 in which the sheet-like recording medium S is loaded and contained. The cassette 17 may be freely put in and taken out from the front side of the apparatus main body 101 (front loading). Reference symbol 17*a* denotes a handle portion which is arranged on a front surface of the cassette 17. The fed recording medium S is introduced to the secondary transfer nip portion which constitutes the contact portion between the secondary transfer roller 32 and the belt 51 at the predetermined control timing by a registration roller pair 19. A secondary transfer bias having a polarity opposite to the charging polarity of the toner and a predetermined electrical potential is applied to the secondary transferring roller 32 from the power supply part (not shown). As a result, in a process in which the recording medium S is nipped and conveyed at the secondary transfer nip portion, four-color superimposed toner images on the belt 51 are sequentially secondary-transferred together on the surface of the recording medium S.

The recording medium S is separated from the surface of the belt 51 to be introduced to a fixing portion 20. The fixing portion 20 performs fixing (fusion color-mixture fixing) of the color toner image of a plurality of colors transferred on the recording medium S. The fixing portion 20 includes a heating roller 21*b* that rotates and a pressure roller 21*a* which is brought into pressure contact with the heating roller 21*b* and applies heat and pressure to the recording medium S. That is, when passing through the fixing portion 20, the recording medium S on which the toner image on the drum 1 is transferred is nipped and conveyed by the fixing roller pair 21*b* and 21*a*. Further, heat and pressure are applied to the recording medium S by the fixing roller pair 21*b* and 21*a*. As a result, the toner image of a plurality of colors is fixed onto the surface of the recording medium S. Then, the recording medium S gets out of the fixing portion 20 and is delivered out of the apparatus main body, as a full-color image formation product, from a delivery portion 24 by a delivery roller pair 23.

In a case of a monochrome image forming mode, only the image formation using the black cartridge 4*k* is performed.

(Cartridge Replacement System)

In the cartridges 4 (4*y*, 4*m*, 4*c* and 4*k*), the developer (toner) contained therein is consumed as being used for the image formation.

Then, for example, means (not shown) that detects a developer remaining amount of each cartridge is provided, and, at the control circuit portion, a detected remaining amount value is compared with a threshold value set in advance for an advance notice of a cartridge life and warning of the cartridge life. Regarding the cartridge whose detected remaining amount value is smaller than the threshold value, the advance notice of the cartridge life or the warning of the cartridge life is displayed on the display portion (not shown). This leads the user to prepare the cartridge for replacement or replace the cartridge, thereby maintaining a quality of the output image.

In the image forming apparatus according to this embodiment, for the purpose of usability improvement, a front access system is adopted as the replacement of the cartridge.

Figure 2:
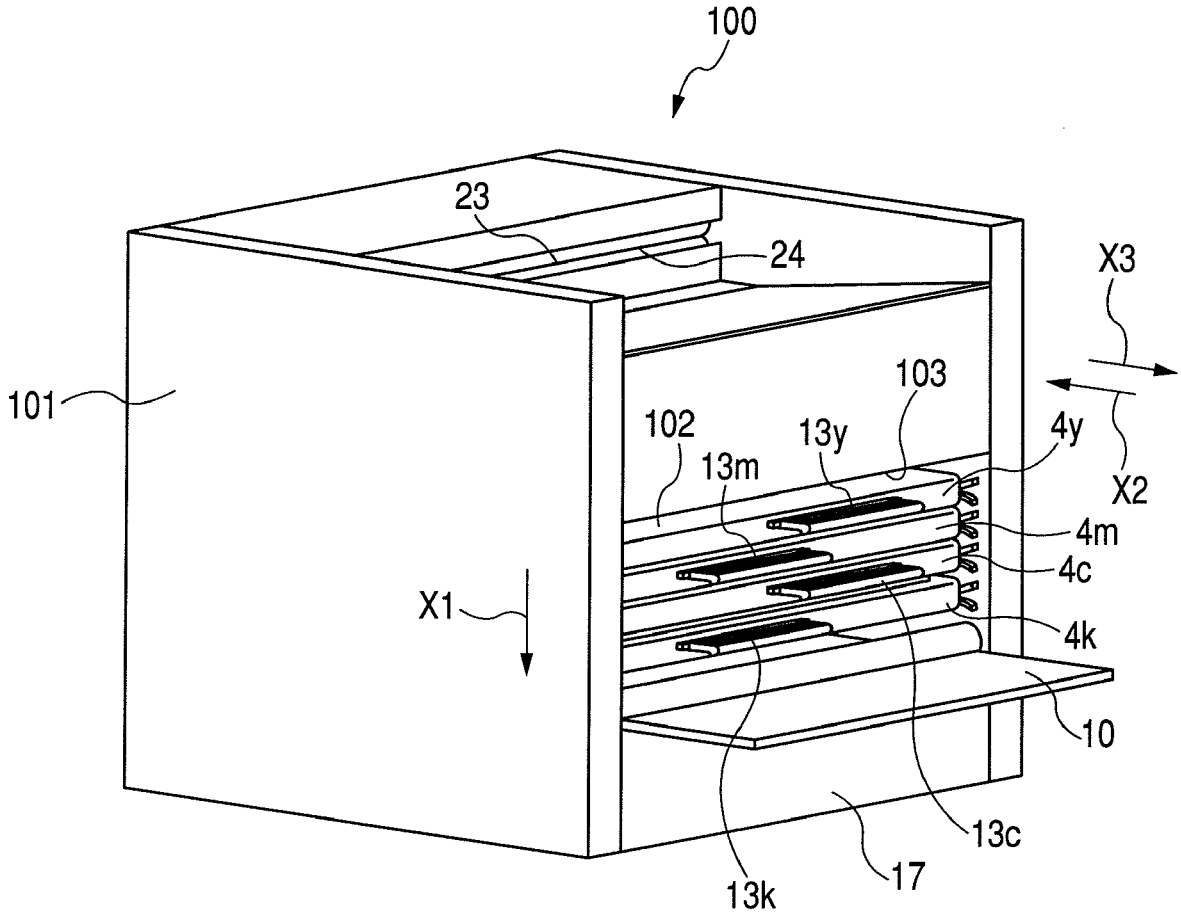
FIG. 2 is an external perspective view of the image forming apparatus with a door being opened.
Figure 3A:
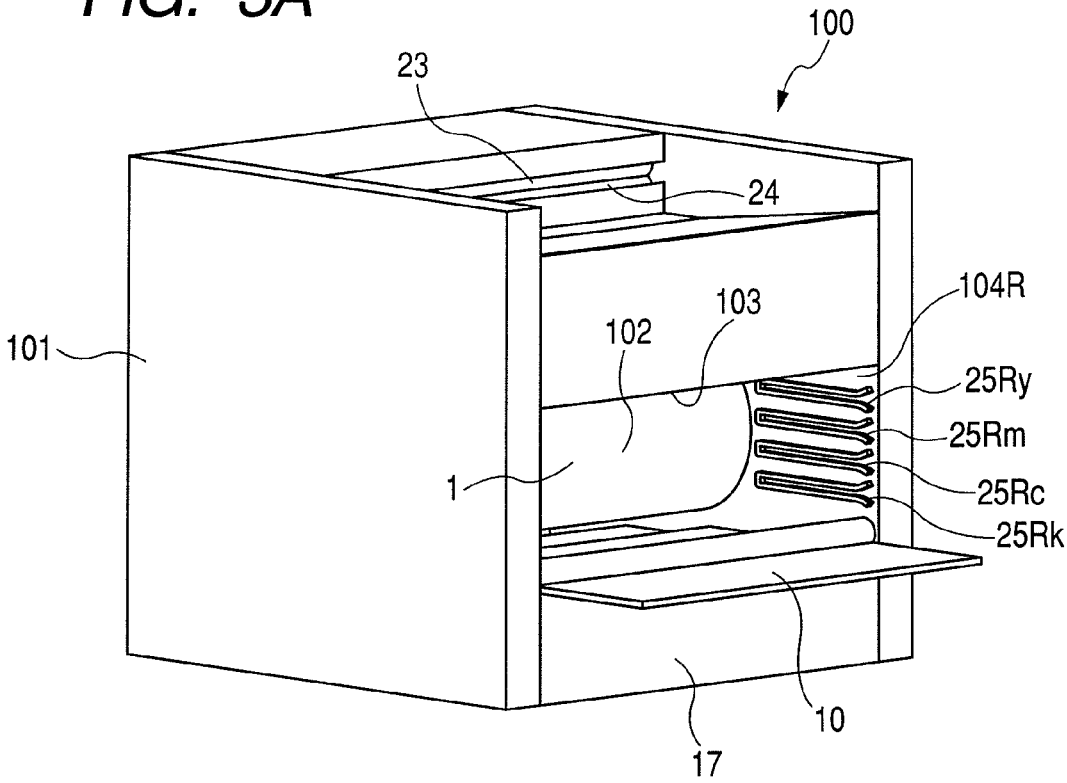
FIGS. 3A and 3B are perspective views, which are viewed from different directions with each other, of an apparatus main body in which the door is opened and no cartridge is mounted to a cartridge mounting portion.
Figure 3B:
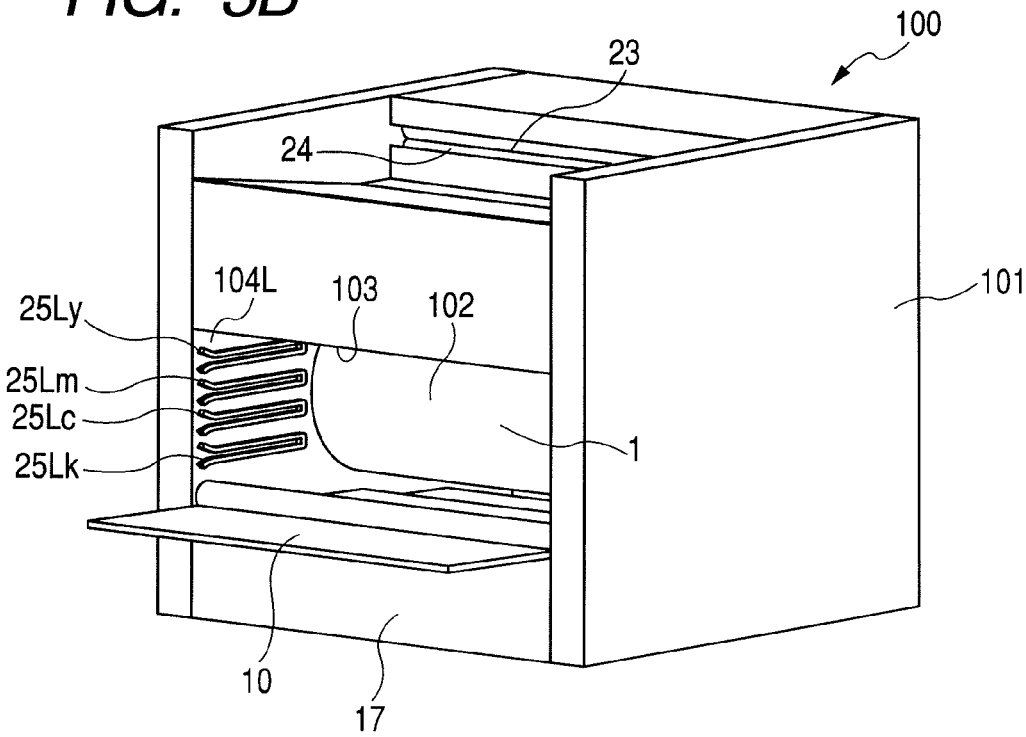

Hereinafter, the front access system is described in detail. On the front surface side of the apparatus main body 101, there is provided an opening portion 103 which allows the cartridges to pass therethrough for the purpose of inserting the cartridges to a cartridge mounting position 102 and for taking out the cartridges from the apparatus main body. Further, there is provided a door 10 serving as an openable and closable member, which is movable between a closing position at which the opening portion 103 is closed and an opening position at which the opening portion 103 is opened. In this embodiment, the door 10 is openable and closable to rotate about a horizontal shaft (hinge shaft) 10*b* on a lower side of the door 10 with respect to the apparatus main body 101. That is, the door 10 rotates about the hinge shaft 10*b* in a vertically-raising direction, and, as illustrated in FIGS. 1A and 1B, may be held at a state of being closed with respect to the opening portion 103 of the apparatus main body 101. By closing the door 10 as described above, the opening portion 103 is closed. Further, by pulling the door 10 to a forward side of the apparatus main body 101 to be rotated about the hinge shaft 10*b*, as illustrated in FIG. 2, the door 10 may be held at a state of being opened from the apparatus main body 101. As a result, the opening portion 103 on the front surface of the apparatus main body is opened. Reference symbol 10*a* denotes a handle portion provided to the door 10. When the door 10 is opened, the cartridge mounting portion 102 is opened, whereby a front surface side (outer surface) of the cartridges 4 mounted to the cartridge mounting portion 102 is exposed to the opening portion 103 as illustrated in FIG. 2. FIGS. 3A and 3B are perspective views, which are seen from different directions, respectively, of the apparatus main body 101 of a state in which the door 10 is opened and the cartridges 4 are not mounted to the cartridge mounting portion 102.

In the cartridge mounting portion 102, guide portions (main body side guide portion and cartridge mounting and detaching guide portion) 25R and 25L are oppositely provided on inner wall surfaces of a right frame 104R and a left frame 104L of the apparatus main body 101, respectively. The guide portions 25R and 25L guide the cartridges 4 when the cartridges 4 are mounted to the apparatus main body 101 and detached from the apparatus main body 101. In this embodiment, four sets of the guide portions 25R and 25L corresponding to the cartridges 4*y*, 4*m*, 4*c* and 4*k* are provided adjacently in the vertical direction. Guide portions 25Ry and 25Ly correspond to the yellow cartridge 4*y*, and guide portions 25Rm and 25Lm correspond to the magenta cartridge 4*m*. Further, guide portions 25Rc and 25Lc correspond to the cyan cartridge 4*c*, and guide portions 25Rk and 25Lk correspond to the black cartridge 4*k*.

Figure 4A:
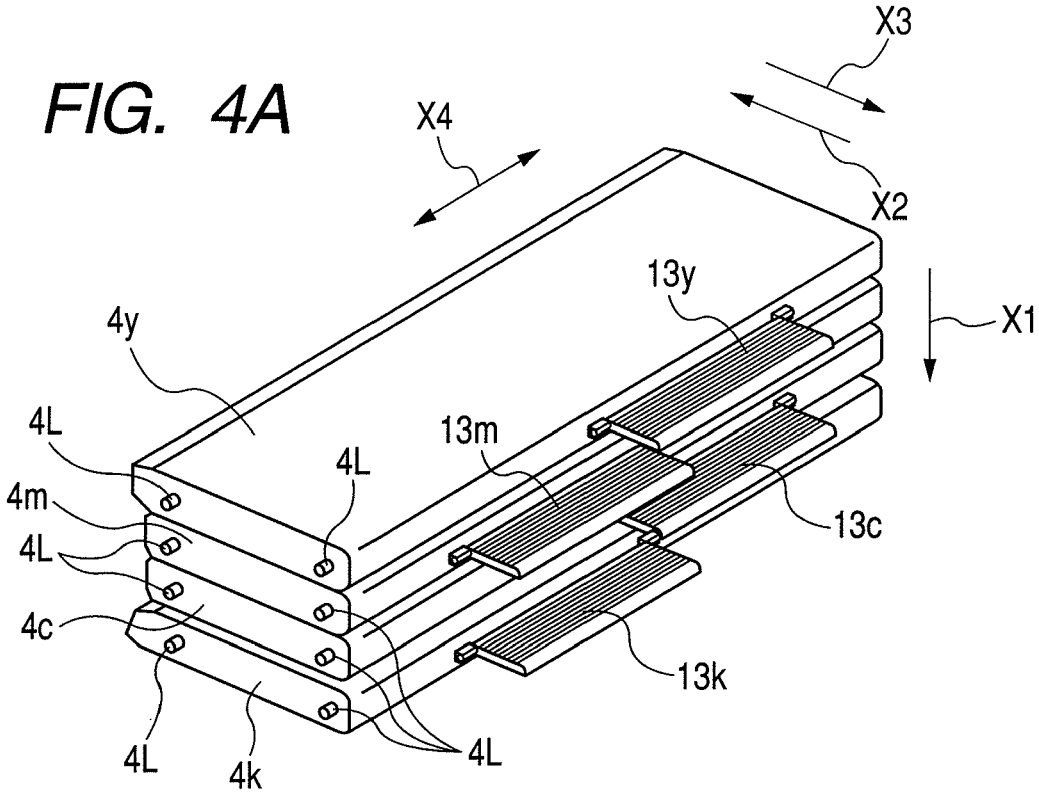
FIG. 4A is a perspective view of a plurality of cartridges viewed from a left-hand side.
Figure 4B:
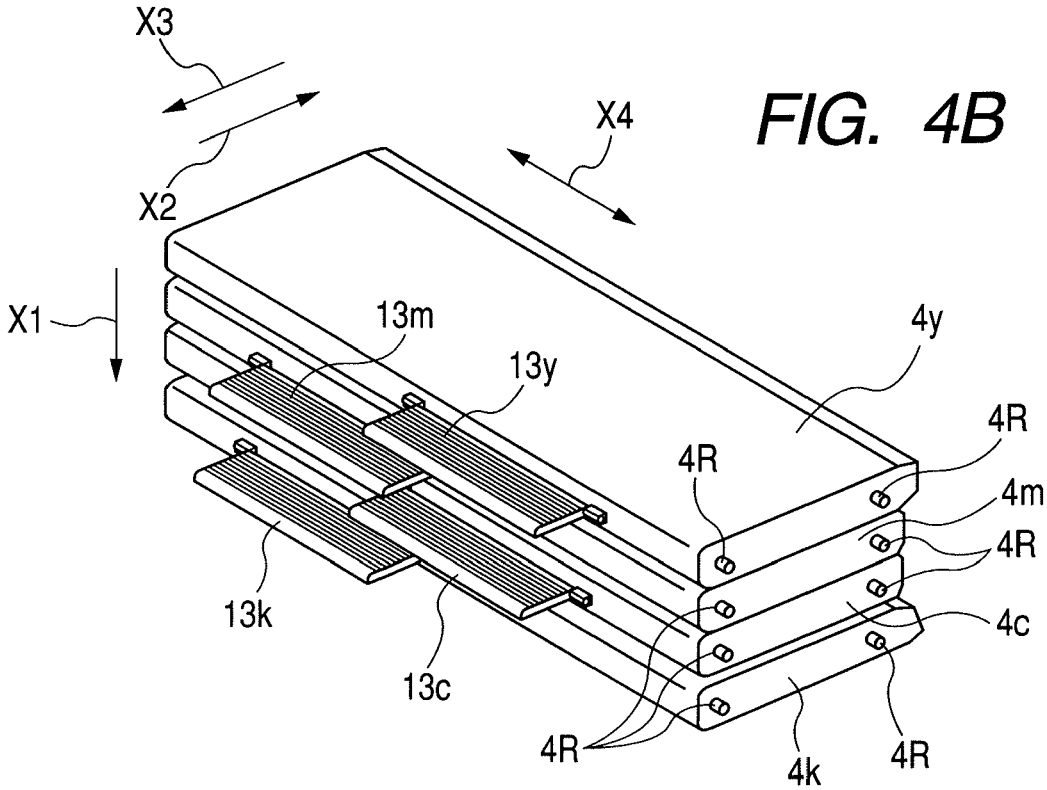
FIG. 4B is a perspective view of the plurality of cartridges viewed from a right-hand side.

FIG. 4A is a perspective view of the cartridges 4*y*, 4*m*, 4*c* and 4*k* when viewed from a left-hand side, and FIG. 4B is a perspective view of the cartridges 4*y*, 4*m*, 4*c*, and 4*k* when viewed from a right-hand side. In a left side surface portion and a right side surface portion of each of the cartridges 4*y*, 4*m*, 4*c* and 4*k*, guided portions 4L and 4R are provided, respectively. Then, the left and right guided portions (cartridge side guide portions) 4L and 4R of the cartridges 4*y*, 4*m*, 4*c* and 4*k* are engaged with the corresponding left and right guide portions 25L and 25R of the cartridge mounting portion 102 side, respectively. By slide-moving the cartridges in the engaging state, the cartridges are mounted to and detached from the cartridge mounting portion 102.

In this case, regarding the guide portions 25R and 25L provided adjacently in the vertical direction and provided at four portions of the left and right sides, though the upper three guide portions are provided at substantially the same intervals, an interval between the lowest guide portions 25Rk and 25Lk and the guide portions 25Rc and 25Lc provided directly thereabove is larger than the above-mentioned intervals. This is because the interval between the guide portions is broadened due to the black cartridge 4*k* having the large capacity, which is inserted into the lowest guide portions 25Rk and 25Lk.

The guide portions 25R and 25L extend in the front-and-rear direction and substantially horizontal direction, and the drum 1 is arranged at a destination thereof. An extending direction of the guide portions 25R and 25L is substantially the same as the mounting and detaching direction of the cartridges 4.

Figure 5:
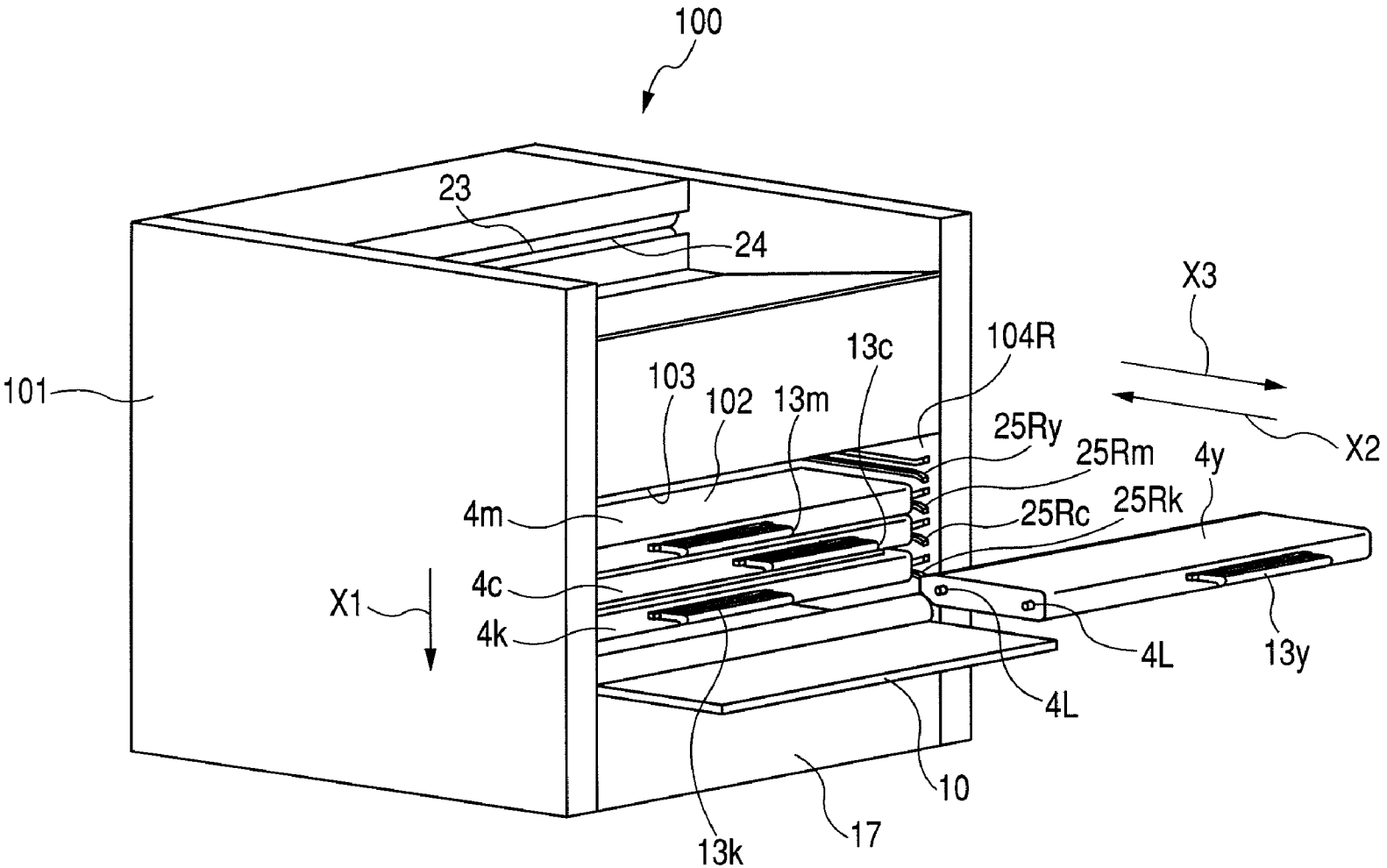
FIG. 5 is a view illustrating how the cartridge is mounted to the apparatus main body.

FIG. 5 is a view illustrating how the cartridge 4 is mounted to the apparatus main body 101. When the user newly uses the apparatus main body, or replaces a used cartridge to a new cartridge 4, the user performs mounting operation of the cartridge 4 to the cartridge mounting portion 102 of the apparatus main body 101.

First, the door 10 is opened. Then, the cartridge mounting and detaching portion 102 is exposed from the opening portion 103, and the right and left guide portions 25R and 25L may be seen. The user grips by hand gripping portions 13 (13*y*, 13*m*, 13*c* and 13*k*) protruding from the outer surfaces of the cartridges 4, and allows the right and left guided portions 4R and 4L to fit to the right and left guide portions 25R and 25L of the cartridge mounting portion 102, to thereby perform the engagement therebetween. Then, the user slides the guided portions 4R and 4L along the guide portions 25R and 25L, and inserts the cartridges 4 into the cartridge mounting portion 102. The mounting direction (arrow X2) of the cartridges 4 is, as described above, substantially the same as the extending direction of the guide portions 25R and 25L, and the cartridges 4 are mounted from the front surface of the apparatus main body 101 in the substantially horizontal direction. FIG. 2 illustrates a state of inserting and mounting all of the four cartridges 4*y*, 4*m*, 4*c* and 4*k*. The cartridges 4 are disposed adjacently in one direction X1 (vertical direction in this embodiment). Then, the door 10 is closed. As a result, the image forming apparatus 100 attaining a state of being capable of performing the image forming operation.

When the cartridge 4 outlives its usefulness, the user performs detaching operation of the cartridge 4 from the apparatus main body 101. Note that, in this case, "unusefulness (finish of lifetime) of the cartridge 4" refers to a state in which the cartridge 4 may not perform image formation of the quality acceptable for the user. The detaching operation is performed in a reverse procedure of the above-mentioned mounting procedure. Specifically, the closed door 10 is opened. As a result, the cartridge mounting portion 102 is opened, and, as illustrated in FIG. 2, the outer surface provided with the gripping portions 13 (13*y*, 13*m*, 13*c* and 13*k*) of the cartridges 4 mounted to the mounting portion 102 is exposed to the opening portion 103. Then, the user grips by hand the gripping portion 13 of the cartridge 4 to be replaced, and slides the guided portions 4R and 4L along the guide portions 25R and 25L, thereby taking out the cartridge 4 outside the cartridge mounting portion 102. In this case, the detaching direction (arrow X3) of the cartridge 4 is exactly opposite to the mounting direction (arrow X2), and the cartridge 4 is detached from the front surface of the apparatus main body 101 in the substantially horizontal direction. The mounting and detaching direction of the cartridges 4 refers to the mounting direction and the detaching direction.

As described above, gripping portions 13 (13*y*, 13*m*, 13*c* and 13*k*) are provided to the cartridges 4. The user grips by hand the gripping portions 13. As a result, the user may easily perform the mounting and detaching operation of the cartridges 4 with respect to the cartridge mounting portion 102 of the apparatus main body 101. The user grips the gripping portions 13 and detachably mounts the cartridges 4 to the apparatus main body 101 with the developing rollers 40 being leading ends. The cartridges 4 are mounted such that the developing rollers 40 come along a circular arc portion of the drum 1. Accordingly, leading end positions of the cartridges 4 mounted to the apparatus main body 101 are out of line in the X2 direction (FIG. 1B). The cartridges 4 perform development of the electrostatic latent image in a state of being mounted to the cartridge mounting portion 102. At this time, in this embodiment, the developing rollers 40 and the photosensitive drum 1 perform the development in a state of having a gap through an intermediation of spacers (not shown). The spacers (not shown) are provided at one end and another end of the developing rollers 40. Note that, apart from this, a process of bringing the developing rollers 40 into contact with the photosensitive drum 1 in performing the development may be used (so-called contact development system).

(Structural Example 1 of Cartridge Gripping Portion)

As illustrated in FIGS. 2, 4A, 4B and 5, the gripping portions 13*y*, 13*m*, 13*c* and 13*k* of the cartridges 4 are disposed out of line with the gripping portions of the cartridges adjacent to each other. That is, the gripping portion 13*y* provided on the yellow cartridge 4*y* is out of line with the gripping portion 13*m* provided on the adjacent magenta cartridge 4*m*. Similarly, the gripping portion 13*c* provided on the cyan cartridge 4*c* is out of line with the gripping portion 13*m* provided on the adjacent magenta cartridge 4*m* and with the gripping portion 13*k* provided on the black cartridge 4*k*. The gripping portion 13*k* provided on the black cartridge 4*k* is out of line with the gripping portion 13*c* provided on the adjacent cyan cartridge 4*c*.

A direction in which the gripping portions are out of line (arrow X4) is a direction orthogonal to the one direction (arrow X1) which is an adjacent direction of a plurality of cartridges 4*y*, 4*m*, 4*c* and 4*k*, and also a direction orthogonal to the mounting and detaching direction (arrows X2 and X3) of the cartridges 4.

As described above, the gripping portions 13*y*, 13*m*, 13*c* and 13*k* are disposed out of line with the gripping portions of the adjacent cartridges in the X4 direction. Therefore, when the user grips any one of the gripping portions 13 of the cartridges 4, it is unlikely that the gripping portions of the adjacent cartridges become obstacles, whereby the gripping portions may be easily gripped.

As described above, the gripping portions 13 provided on the cartridges 4 are disposed, in the mounting direction X2 of mounting the cartridges 4 to the apparatus main body 101, on the rear end side of the cartridges. Further, the gripping portions may protrude from the rear end toward an upstream in the mounting direction X2. Further, when the user mounts and detaches the cartridges 4 to and from the apparatus main body 101, the user may grip the gripping portions 13 of the protruding state.

Further, in the state in which the cartridges 4 are mounted to the apparatus main body 101, at least one of the gripping portions is disposed out of line with the gripping portions 13 of the adjacent cartridges 4 in the X4 direction orthogonal to the mounting direction X2. In this case, the X4 direction orthogonal to the mounting direction X2 refers to a longitudinal direction of the cartridges 4, that is, the longitudinal direction of the developing rollers 40. Accordingly, the cartridges 4 are mounted to and detached from the apparatus main body 101 in the direction orthogonal to the longitudinal direction of the developing rollers 40. Note that, the X4 direction refers to the longitudinal direction of the cartridges 4. Further, the X4 direction refers to the longitudinal direction of the developing rollers 40. The cartridges 4 are moved in the direction orthogonal to the longitudinal direction of the cartridges 4 and mounted to and detached from the apparatus main body 101.

As a result, when mounting and detaching the cartridges 4 to and from the apparatus main body 101, the user may easily grip the gripping portions 13. Accordingly, an operability of mounting and detaching the cartridges 4 to and from the apparatus main body 101 may be improved.

Figure 6:
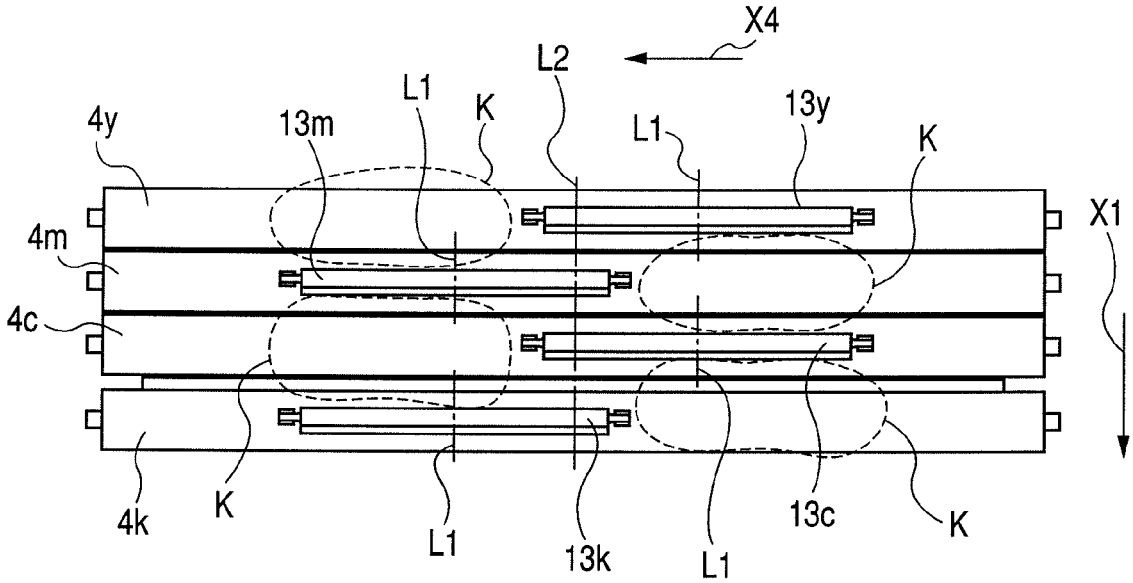
FIG. 6 is a view of cartridge gripping portions of a structural example 1.

FIG. 6 is a front view of the cartridges 4 (4*y*, 4*m*, 4*c* and 4*k*) of FIG. 4A. The gripping portions 13 (13*y*, 13*m*, 13*c* and 13*k*) are disposed out of line with each other. Therefore, spaces K are formed in the X1 direction of the gripping portions 13*y*, 13*m*, 13*c* and 13*k*. The user may put his/her hand into the spaces K when gripping any one of the gripping portions 13 of the cartridges 4. Therefore, the user may easily grip the gripping portions 13. Compared with a case where the gripping portions 13*y*, 13*m*, 13*c* and 13*k* are not out of line with each other, substantially-double-wide spaces may be formed.

Further, longitudinal center lines L1 of the gripping portions 13*y*, 13*m*, 13*c* and 13*k* do not overlap the adjacent gripping portions 13. Accordingly, when taking into consideration that the user grips the gripping portions 13 at the substantially center thereof, the user may more easily grip the gripping portions 13 compared with a case where the gripping portions 13 are just out of line with each other. That is, the spaces K in the X1 direction of the gripping portions 13*y*, 13*m*, 13*c* and 13*k* may be wider.

Further, as illustrated in FIG. 6, the gripping portions 13*y*, 13*m*, 13*c* and 13*k* are disposed so as to overlap a center line L2 in the longitudinal direction which is a lateral direction of the cartridges 4. Accordingly, when assuming that a center of gravity each of the cartridges 4 is in the vicinity of the substantially longitudinal center thereof, the gripping portions 13*y*, 13*m*, 13*c* and 13*k* are provided at positions in which the gripping portions are not so separated from the gravity centers of each of the cartridges 4*y*, 4*m*, 4*c* and 4*k*. Therefore, it is unlikely that the cartridges 4 are inclined by the weight of the cartridges 4 when the gripping portions 13 are gripped.

(Structural Example 2 of Cartridge Gripping Portion)

Figure 7:
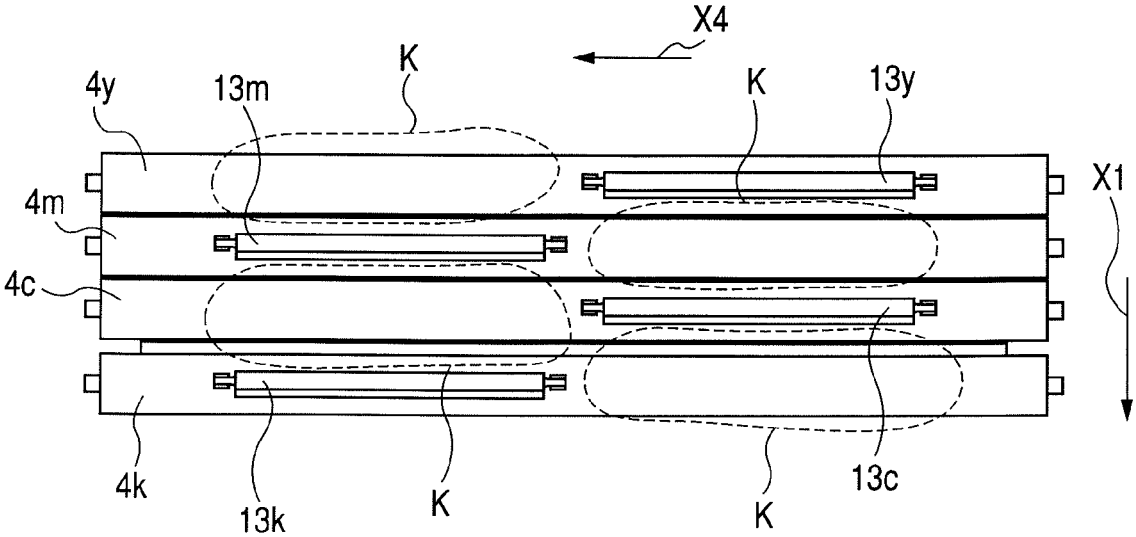
FIG. 7 is a view of cartridge gripping portions of a structural example 2.

FIG. 7 illustrates an example in which, unlike the structural example 1 (FIG. 6) of the cartridge gripping portions, the gripping portions 13 are further displaced in a direction of the arrow X4. In this example, the gripping portions 13*y*, 13*m*, 13*c* and 13*k* in the X4 direction do not overlap the gripping portions of the adjacent cartridges. That is, the gripping portions 13 are provided at the positions in which the gripping portions 13 do not overlap with the gripping portions provided on the adjacent cartridges in the orthogonal X4 direction.

Accordingly, the user may more easily grip any one of the gripping portions 13 of the cartridges 4 compared with the structural example 1. That is, the spaces K in the direction of the arrow X1 are widened in the direction of the arrow X4 compared with the spaces K of the structural example 1. Accordingly, compared with the structural example 1, the user may more easily grip the gripping portions 13.

(Structural Example 3 of Cartridge Gripping Portion)

Figure 8:
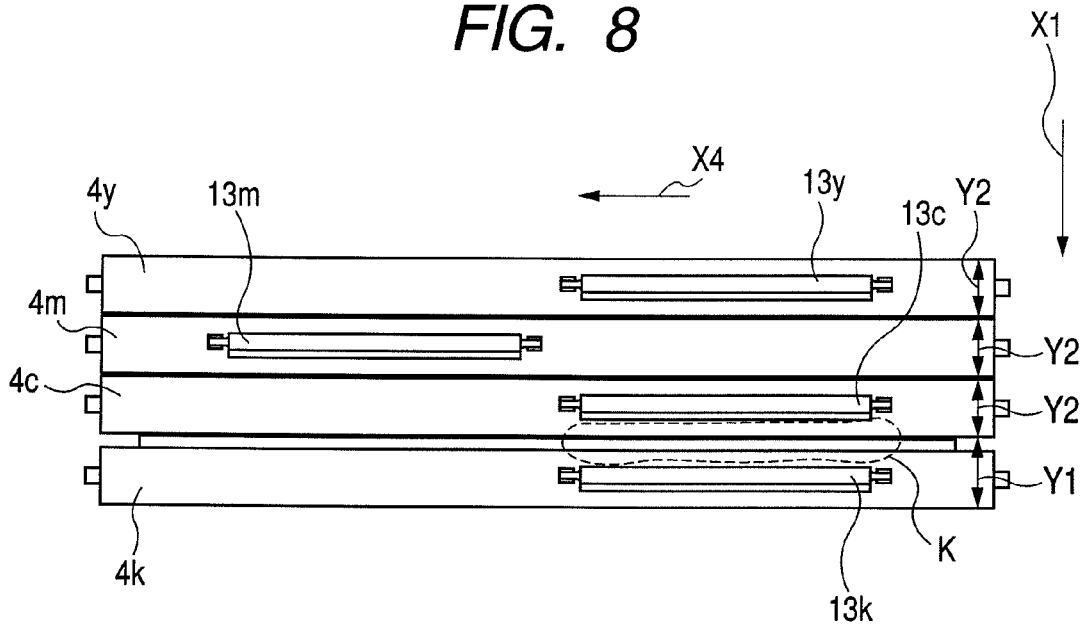
FIG. 8 is a view of cartridge gripping portions of a structural example 3.

FIG. 8 illustrates an example in which, unlike the structural example 2 (FIG. 7) of the cartridge gripping portions, the position of the gripping portion 13*k* of the black cartridge 4*k* is changed. The gripping portion 13*k* of the black cartridge 4*k* is not out of line with the gripping portion 13*c* of the adjacent cyan cartridge 4*c*. As described above, the black cartridge 4*k* has a large capacity, and hence a gap Y1 between the cyan cartridge 4*c* and the black cartridge 4*k* is set to be larger than gaps Y2 between other cartridges. Thus, regarding the black cartridge 4*k*, the gripping portion 13*c* of the adjacent cyan cartridge 4*c* does not become the obstacle without making the gripping portion 13*k* out of line therewith. That is, when a space K of the gripping portion 13*k* in the direction of the arrow X1 is sufficiently wide, the gripping portions may not be out of line with each other, or only the gripping portion 13*m* of the magenta cartridge 4*m* may be out of line with the other gripping portions 13.

(Structural Example 4 of Cartridge Gripping Portion)

Figure 9:
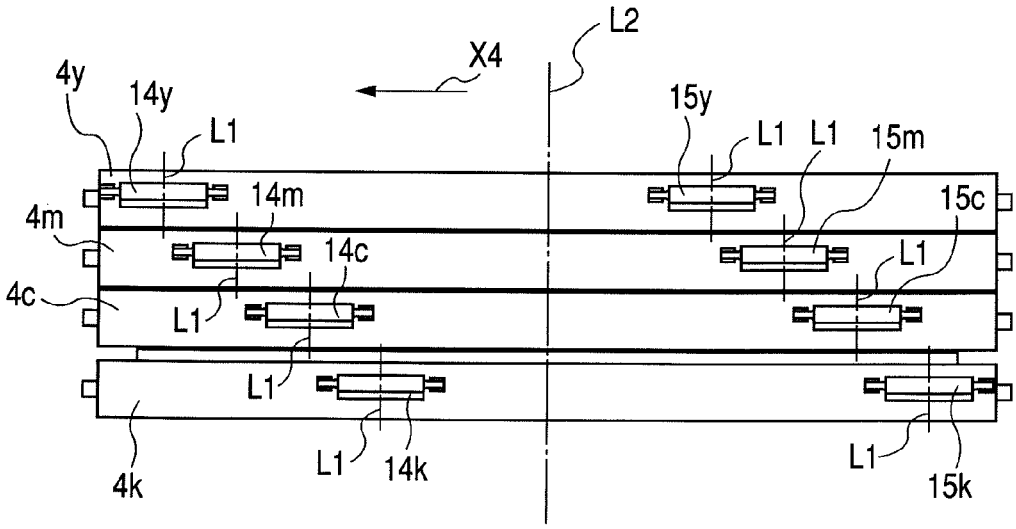
FIG. 9 is a view of cartridge gripping portions of a structural example 4.

FIG. 9 illustrates an example in which, unlike the structural examples 1 to 3 (FIGS. 6, 7 and 8) of the cartridge gripping portions, two gripping portions are provided on each of the cartridges 4 (4*y*, 4*m*, 4*c* and 4*k*).

The user grips, by both hands, first gripping portions 14 (14*y*, 14*m*, 14*c* and 14*k*) provided at one end portions and second gripping portions 15 (15*y*, 15*m*, 15*c* and 15*k*) provided at another end portions in the lateral direction of the cartridges 4*y*, 4*m*, 4*c* and 4*k*. In this manner, the user performs mounting and detaching operation of the cartridges 4. The user may hold the cartridges 4 by both hands, and hence the user may more stably hold the cartridges 4 compared with the case of operating by hand (structural examples 1 to 3).

Regarding the first and second gripping portions 14 and 15 of this case, similarly to the structural examples 1 to 3, the gripping portions 14 and 15 are disposed out of line with the gripping portions of the adjacent cartridges in the X4 direction. As a result, it is unlikely that the gripping portions of the adjacent cartridges become the obstacles when the user grips the first and second gripping portions 14 and 15 of any one of the cartridges 4, and hence the user may easily hold the gripping portions.

Further, the longitudinal center lines L1 of the gripping portions 14 and 15 do not overlap the adjacent gripping portions. Accordingly, when taking into consideration that the user grips the first and second gripping portions 14 and 15 at the substantially center thereof, the user may more easily grip the gripping portions 14 and 15 compared with a case where the gripping portions 14 and 15 are just out of line with each other. That is, the spaces above and below the gripping portions 14 and 15 may be wider.

Further, as illustrated in FIG. 9, the griping portions 14 and 15 are provided so as to put the longitudinal center line L2 of the cartridges 4 therebetween. Accordingly, when assuming that the center of gravity of each of the cartridges 4 is in the vicinity of the substantially longitudinal center thereof, the user may grip each of the cartridges 4 at both sides which puts the center of gravity therebetween. In this manner, the user may stably hold the cartridges 4.

(Structural Example 5 of Cartridge Gripping Portion)

Figure 10:
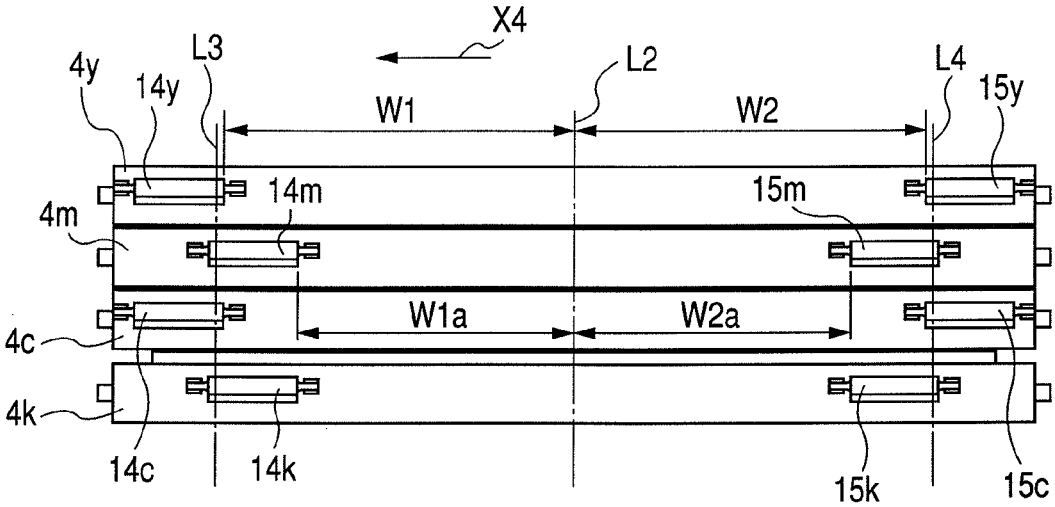
FIG. 10 is a view of cartridge gripping portions of a structural example 5.

FIG. 10 illustrates an example in which, unlike the structural example 4 (FIG. 9) of the cartridge gripping portions, the first gripping portions 14 and the second gripping portions 15 are disposed so as to have an equal distance from the longitudinal center line L2 which is interposed therebetween and which is the lateral direction of the cartridges 4. A distance W1 and a distance W2 of the yellow cartridge 4*y*, which are a distance from a center L2 to the first gripping portion 14*y*, and a distance from the center L2 to the second gripping portion 15*y*, respectively, are equal with each other. Similarly, each pair of the gripping portions 14*m* and 15*m* of the magenta cartridge 4*m*, the gripping portions 14*c* and 15*c* of the cyan cartridge 4*c*, and the gripping portions 14*k* and 15*k* of the black cartridge 4*k* has equal distances from the center L2 of the cartridges 4. Accordingly, when assuming that the center of gravity of each of the cartridges 4 is in the vicinity of the substantially longitudinal center thereof, the user may grip the gripping portions 14 and 15 at the positions of substantially equal distance from the center of gravity, whereby the user may more stably hold the cartridges 4.

Further, the first gripping portions 14 (14*y*, 14*m*, 14*c* and 14*k*) are alternately provided laterally while an X4 direction center line L3 with the adjacent gripping portions being interposed therebetween. Further, the second gripping portions 15 (15*y*, 15*m*, 15*c* and 15*k*) are also alternately provided laterally while an X4 direction center line L4 with the adjacent gripping portions being interposed therebetween. Accordingly, the user may grip the gripping portions 14 and 15 at both ends of the cartridges 4. Therefore, the user may stably hold the cartridges 4.

In this embodiment, the cartridges 4 mounted to the apparatus main body 101 include the first gripping portions 14 and the second gripping portions 15. Further, in the direction (X4) orthogonal to the mounting direction (X2) in which the cartridges 4 (4*y* and 4*c*) are mounted to the apparatus main body 101, the distance W1 from the center L2 of the cartridges 4 to the first gripping portions 14 is equal to the distance W2 from the center L2 to the second gripping portions 15. Further, a distance W1*a* from the center L2 of the cartridges 4 (4*m* and 4*k*) which are adjacent to the cartridges 4 (4*y* and 4*c*), respectively, to the first gripping portions 14 is equal to the distance (W2*a*) from the center L2 to the second gripping portions 15. Further, the distances W1 and W2 of the cartridges 4 (4*y* and 4*c*) are different from the distances W1*a* and W2*a* of the cartridges 4 (4*m* and 4*k*) which are adjacent to the cartridges 4 (4*y* and 4*c*).

With this structure, in this embodiment, the user may easily grip the gripping portions 14 and 15. Further, the user may grip the gripping portion 14 by one hand, and grip the gripping portion 15 by the other hand.

(Structural Example 6 of Cartridge Gripping Portion)

Figure 11:
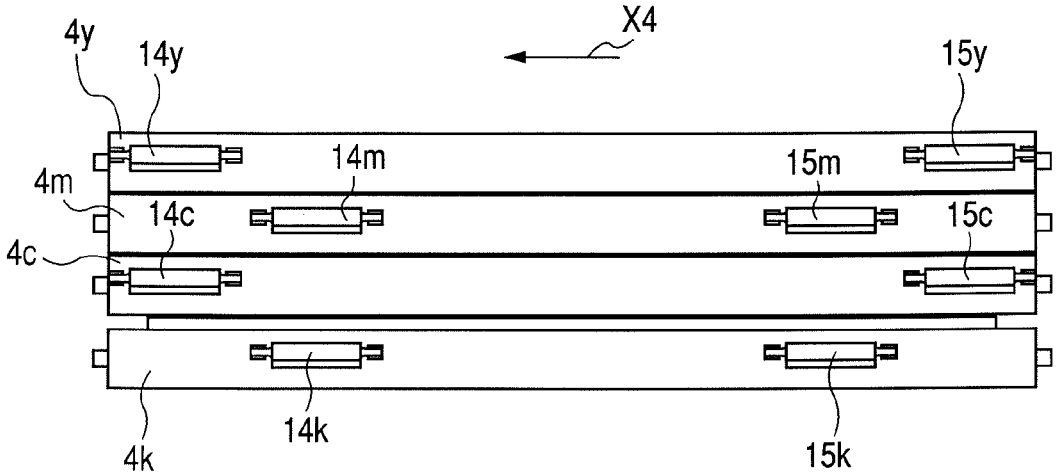
FIG. 11 is a view of cartridge gripping portions of a structural example 6.

FIG. 11 illustrates an example in which, unlike the structural example 5 (FIG. 10) of the cartridge gripping portions, the gripping portions 14 and 15 are further displaced in the arrow X4 direction. In this example, in the X4 direction, the gripping portions 14 and 15 do not overlap the gripping portions of the adjacent cartridges. Accordingly, the user may more easily grip the gripping portions 14 and 15 compared with the above-mentioned example 5.

(Structural Example 7 of Cartridge Gripping Portion)

Figure 12:
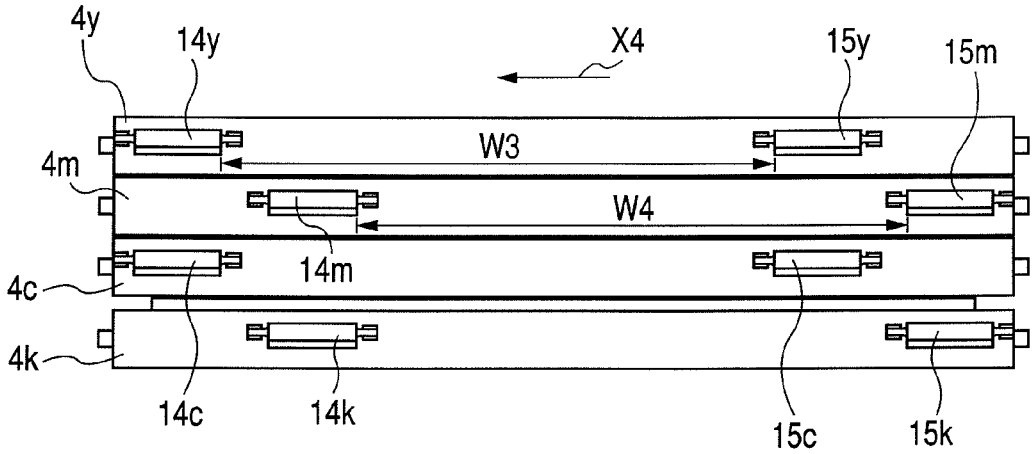
FIG. 12 is a view of cartridge gripping portions of a structural example 7.

FIG. 12 is an example in which, unlike the structural example 5 (FIG. 10) and the structural example 6 (FIG. 11) of the cartridge gripping portions, distances between the first gripping portions 14 and the second gripping portions 15 of the cartridges 4*y*, 4*m*, 4*c* and 4*k* are equal to each other. A distance W3 from the first gripping portion 14*y* to the second gripping portion 15*y* of the yellow cartridge 4*y* is equal to a distance W4 from the first gripping portion 14*m* to the second gripping portion 15*m* of the magenta cartridge 4*m*. Similarly, a distance from the first gripping portion 14*c* to the second gripping portion 15*c* of the cyan cartridge 4*c* is equal to a distance from the first gripping portion 14*k* to the second gripping portion 15*k* of the black cartridge 4*k*. Accordingly, compared with the structural examples 5 and 6, distances between the gripping portions of every cartridge 4 are uniform, and hence the user may more easily hold the gripping portions. That is, if the distances between the gripping portions are different in every cartridge, differences in the cartridge operability are generated. However, according to this example, the distances between the gripping portions may be uniform. Accordingly, no difference is generated in the operability of the cartridges 4, and hence the user may operate the cartridges easily.

(Structural Example 8 of Cartridge Gripping Portion)

Figure 13:
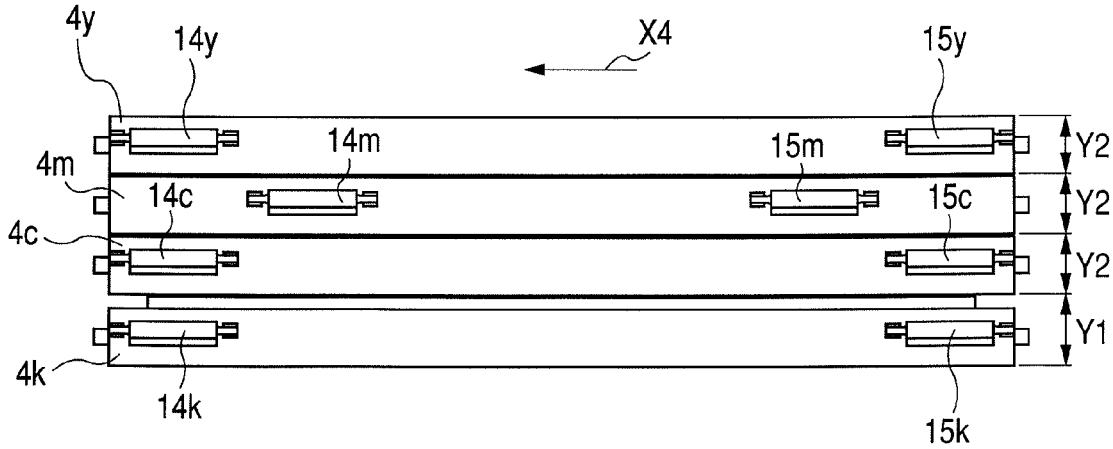
FIG. 13 is a view of cartridge gripping portions of a structural example 8.

FIG. 13 illustrates an example in which, unlike the structural example 7 (FIG. 12) of the cartridge gripping portions, positions of the gripping portions 14*k* and 15*k* of the black cartridge 4*k* are changed. As illustrated in the structural example 3 (FIG. 8), this structure is applicable when the black cartridge 4*k* has a large capacity, and the gap Y1 with the adjacent cyan cartridge 4*c* is set larger than other gaps Y2 between other cartridges. The effect thereof is the same as that of the structural example 3.

(Storage Structure Example 1 of Cartridge Gripping Portion)

Figure 14A:
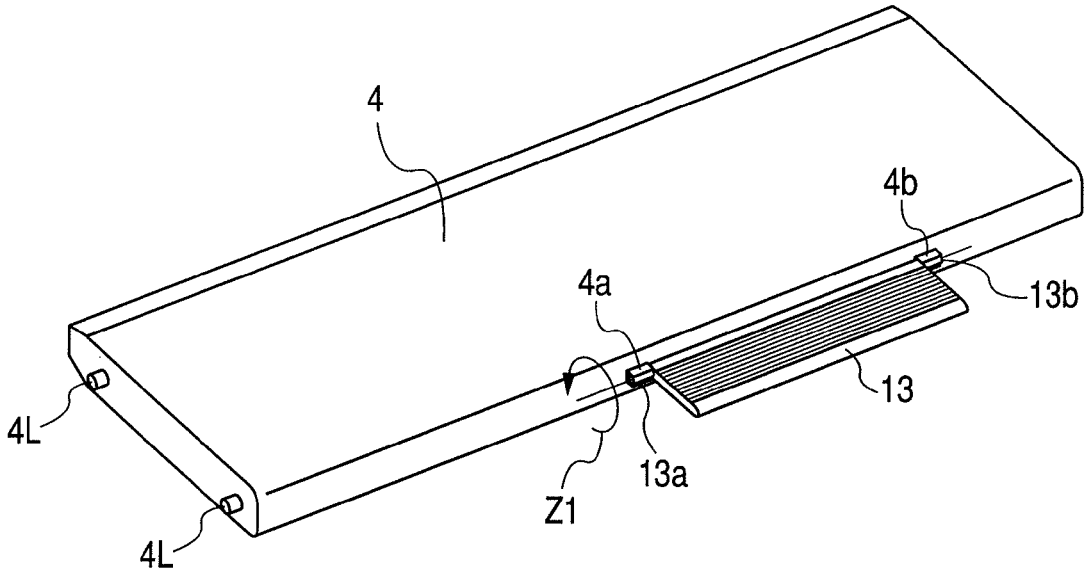
FIG. 14A is an enlarged view of one of the gripping portions of the cartridges illustrated in the structural example 1 of the cartridge gripping portion.
Figure 14B:
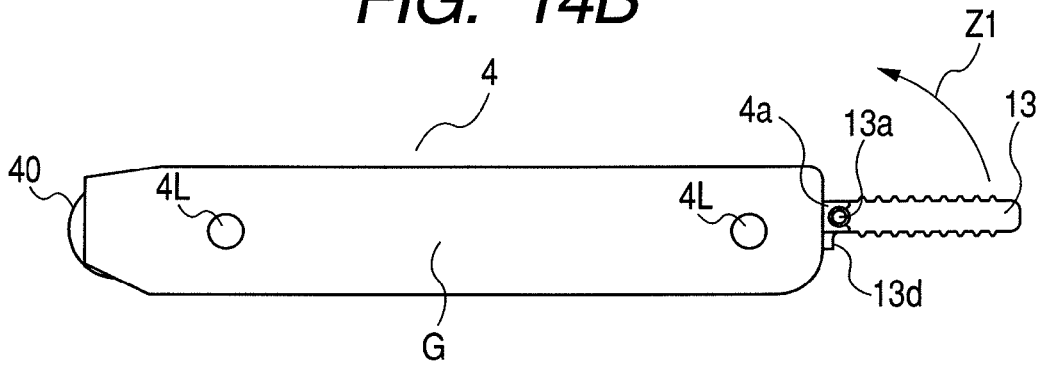
FIGS. 14B and 14C are side views of the cartridge.
Figure 14C:
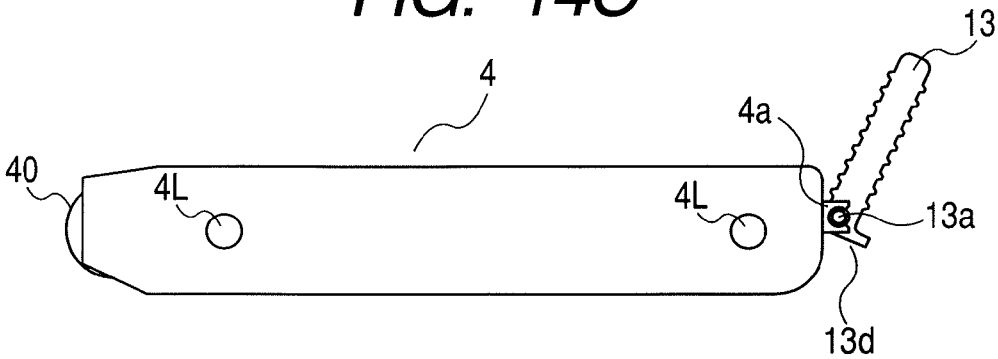

FIG. 14A is an enlarged view of one of the gripping portions 13 of the cartridges 4 illustrated in the above-mentioned structural example 1 (FIG. 6) of the cartridge gripping portions. FIGS. 14B and 14C are side views of one of the cartridges 4.

The gripping portions 13 of the cartridges 4 have shaft portions 13*a* and 13*b* on both longitudinal end portions (lateral end portions) thereof, and the shaft portions 13*a* and 13*b* are attached to attaching portions 4*a* and 4*b* provided to a frame of the cartridges 4.

That is, the attaching portions 4*a* and 4*b* are, in the mounting direction X2 of mounting the cartridges 4 to the apparatus main body 101, disposed on the rear end side of the cartridges 4. The attaching portions 4*a* and 4*b* have a semicircular shape such that the shaft portions 13*a* and 13*b* may rotate. Accordingly, the gripping portions 13 may protrude in the mounting direction X2 from the rear end side to the upstream side.

Inlets of the attaching portions 4*a* and 4*b* are formed into a snap-fit shape, and prevent the shaft portions 13*a* and 13*b* from being detached from the attaching portions 4*a* and 4*b* after the attachment of the shaft portions 13*a* and 13*b* to the attaching portions 4*a* and 4*b*.

The gripping portions 13 may rotate (move) about the shaft portions 13*a* and 13*b* in an arrow Z1 direction.

FIG. 14C is a side view illustrating a state after rotation of the gripping portion 13. Like this, the gripping portion 13 may move between a protruded position as illustrated in FIGS. 14A and 14B, of protruding from the outer surface of the frame of the cartridge 4, and a retracted position (stored position) as illustrated in FIG. 14C, at which a part of the gripping portion 13 is closer to the outer surface of the cartridge 4 than at the protruded position.

Note that, the state in which the gripping portions 13 (14 and 15) are positioned at the protruded position is illustrated in, for example, FIG. 2, FIGS. 4A 4B, 5, 6, 7, 8, 9, 10, 11, 12, 13, 14A and 14B. In addition, the state in which the gripping portions 13 (14 and 15) are positioned at the retracted position is illustrated in, for example, FIGS. 1B, 14C, 15, 16 and 17.

In this case, the retracted position refers to a position at which a space required for the gripping portions 13 to protrude toward the upstream side in the mounting direction X2 is reduced compared with the protruded position. Specifically, the retracted position refers to a position at which a leading end of the gripping portion 13 at the retracted position is positioned closer to the outer surface of the frame of the cartridge 4 than the leading end of the gripping portion 13 at the protruded position. That is, the retracted position is a position at which the gripping portion 13 is positioned on the opposite side of the upstream side compared with the protruded position.

Further, the gripping portion 13 is provided with a stopper 13*d*, which regulates the rotation of the gripping portion 13 in the opposite direction of the arrow Z1 direction. That is, the stopper 13*d* abuts a part of the frame of the cartridge 4 to regulate further movement. As a result, the user may stably hold the cartridge 4 even when holding the cartridge 4 by gripping the gripping portion 13.

Usually, assuming that when the user grips the gripping portion 13 to perform the mounting and detaching operation of the cartridge 4, the center of gravity of the cartridge 4 is substantially at the center of the cartridge 4, the stopper 13*d* abuts the frame of the cartridge 4. As a result, the gripping portion 13 maintains the protruded position as illustrated in FIGS. 14A and 14B.

Figure 15:
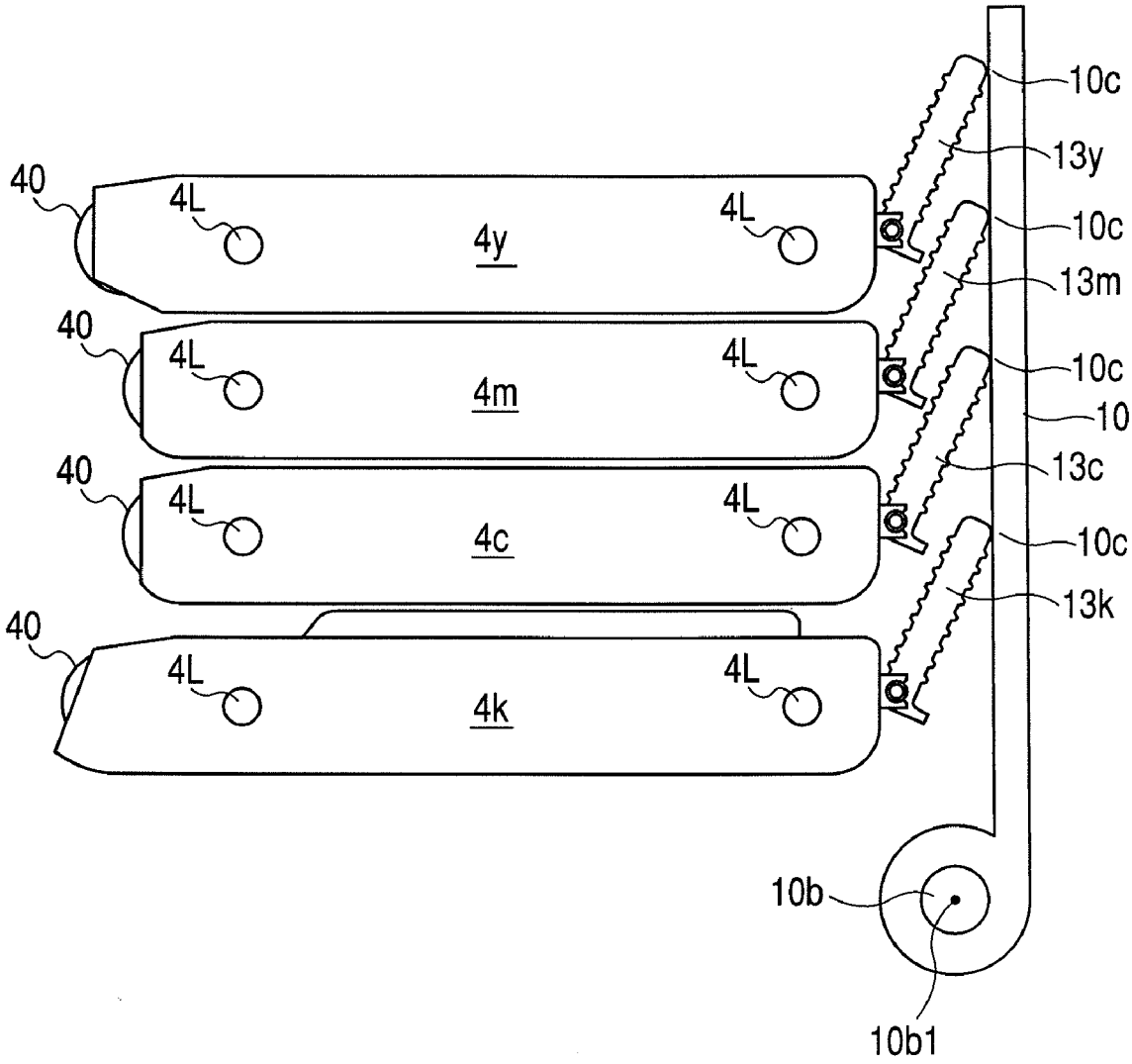
FIG. 15 is a side view illustrating structure around the cartridges when the gripping portions are positioned at retracted positions.

Then, the cartridges 4 are mounted to the mounting portion 103 of the apparatus main body 101, and the door (openable and closable member) 10 is closed, whereby abutment portions 10*c* (FIG. 15) abut a part of the gripping portions 13 to move the gripping portions 13 from the protruded position to the retracted position. FIG. 15 is a side view illustrating a structure around the cartridges 4 when the gripping portions 13 are positioned at the retracted position.

Note that, when the door 10 is opened, the gripping portions are positioned at the protruded position due to their own weight. Accordingly, in the state of opening the door 10, the user may easily recognize the gripping portions 13.

With movable structure of the gripping portions 13 as described above, the gripping portions may be reduced in size in the lateral direction (mounting direction X2 direction, depth direction) of FIG. 15.

That is, the gripping portions 13 may be moved from the protruded position to the retracted position, and hence the size of the apparatus main body 101 in the cartridge mounting direction X2 may be reduced. The size of the apparatus main body 101 in the depth direction may be reduced.

Further, according to the above-mentioned embodiment, the gripping portions 13 rotate about rotation centers (shaft portions 13*a* and 13*b*), thereby being moved from the protruded position to the retracted position. Further, the moving direction (rotating direction) when the door 10 is closed is the same as the moving direction (rotating direction) when the gripping portions 13 move from the protruded position to the retracted position. As a result, in this embodiment, it is only necessary to close the door 10 for moving the gripping portions 13 from the protruded position to the retracted position.

Further, according to this embodiment, the abutment portions 10*c* provided on the door 10 abut a part of the gripping portions 13 through the closing operation of the door 10. As a result, the gripping portions 13 rotate upward about the rotation centers (shaft portions 13*a* and 13*b*) to move from the protruded position to the retracted position. Further, when the door 10 is opened, the gripping portions 13 may move from the retracted position to the protruded position by their own weight. This is because the gripping portions 13 at the retracted position are supported by the door 10 in a state of obliquely upwardly being inclined toward the door 10 with the shaft portions 13*a* and 13*b* being directed downward. Therefore, when the door 10 is opened, the gripping portions 13 lose the support by the door 10, thereby being moved by their own weight from the retracted position to the protruded position.

Further, in the state of being positioned at the retracted position, the gripping portions 13 are positioned at a space between the door 10 and the cartridges 4. As a result, according to this embodiment, it is possible to use the space effectively.

Further, in the state of being positioned at the retracted position, the gripping portions 13 overlap the adjacent cartridges 4 when seen from the mounting direction X2. That is, when seen from the mounting direction X2, the gripping portion 13*m* overlaps the cartridge 4*y* adjacent to the cartridge 4*m*. Further, when seen from the mounting direction X2, the gripping portion 13*c* overlaps the cartridge 4*m* adjacent to the cartridge 4*c*. Further, when seen from the mounting direction X2, the gripping portion 13*k* overlaps the cartridge 4*c* adjacent to the cartridge 4*k*. With this structure, according to this embodiment, even when the gripping portions 13 are enlarged in order that the user may easily grip the gripping portions 13, the size in depth (X2 direction) of the apparatus main body 101 may be reduced.

In this embodiment, the hinge shaft 10*b* (rotation center 10*b*1) is provided below the shaft portions 13*a* and 13*b* provided to the cartridges 4 mounted to the apparatus main body 101. With this structure, the door 10 is closed from bottom up. As a result, the gripping portions 13 positioned at the protruded position are rotated upward about the shaft portions 13*a* and 13*b* as the rotation center, thereby being moved to the retracted position. Accordingly, the size in depth (X2 direction) of the apparatus main body 101 may be reduced. In addition, when the door 10 is opened, the gripping portions 13 positioned at the retracted position may be moved (rotated) to the protruded position by the own weight of the gripping portions 13. Therefore, there is no need to use an elastic member and the like for the purpose of moving the gripping portions 13 positioned at the retracted position to the protruded position.

Note that, the same holds for an embodiment illustrated in FIG. 17 described below. Further, the same structure may be applied to the gripping portions 14 and 15.

Further, with the movable structure of the gripping portions 13, a protruding amount of the gripping portions 13 may be set large. In other words, the user may more easily grip the cartridges 4. The large protruding amount of the gripping portions 13 has an insignificant effect on the increase in size of the apparatus main body 101 because there is adopted structure in which the gripping portions 13 may move to the retracted position.

In this example, there is described the movable structure of the gripping portions described in the structural example 1 of the cartridge gripping portions, and the same structure may be applied to the gripping portions of the other structural examples 2 to 8.

That is, also in the first gripping portions 14 (14*y*, 14*m*, 14*c* and 14*k*) and the second gripping portions 15 (15*y*, 15*m*, 15*c* and 15*k*) which are illustrated in FIG. 9, the similar shaft portions 14*a*, 14*b*, 15*a* and 15*b* are provided. Further, the similar attaching portions 4*a*, 4*b*, 5*a*, and 5*b* are provided. Still further, the similar stoppers 14*d* and 15*d* are provided. In this example, there is adopted structure in which the gripping portions 13 are moved by the door 10 as a starting point. Apart from this, the gripping portions 13 may be moved by their own weight. Alternatively, there may be adopted structure in which an urging member is allowed to abut the gripping portions, and the gripping portions are moved by an urging force of the urging member. Further, the gripping portions may be moved from the protruded position to the retracted position by allowing a part of the gripping portions to abut the apparatus main body through the mounting operation of the cartridges to the apparatus main body.

As described above, the gripping portions 13 are movable between the protruded position of protruding from the outer surface of the rear end side of the cartridges 4 to the upstream side in the cartridge mounting direction X2, and the retracted position of being closer to the outer surface than the protruded position. Further, the gripping portions 13 are gripped by the user in the state of being positioned at the protruded position. Further, the apparatus main body 101 includes the opening portion 103 for mounting and detaching the cartridges 4 and the door 10 for opening and closing the opening portion 103. Then, the abutment portions 10*c* provided to the door 10 abut the part of the gripping portions 13 through the closing operation of the door 10. As a result, the gripping portions 13 move from the protruded position to the retracted position. Note that, the retracted position is opposite to the upstream side in the mounting direction X2 compared with the protruded position.

(Storage Structure Example 2 of Cartridge Gripping Portion)

Figure 16:
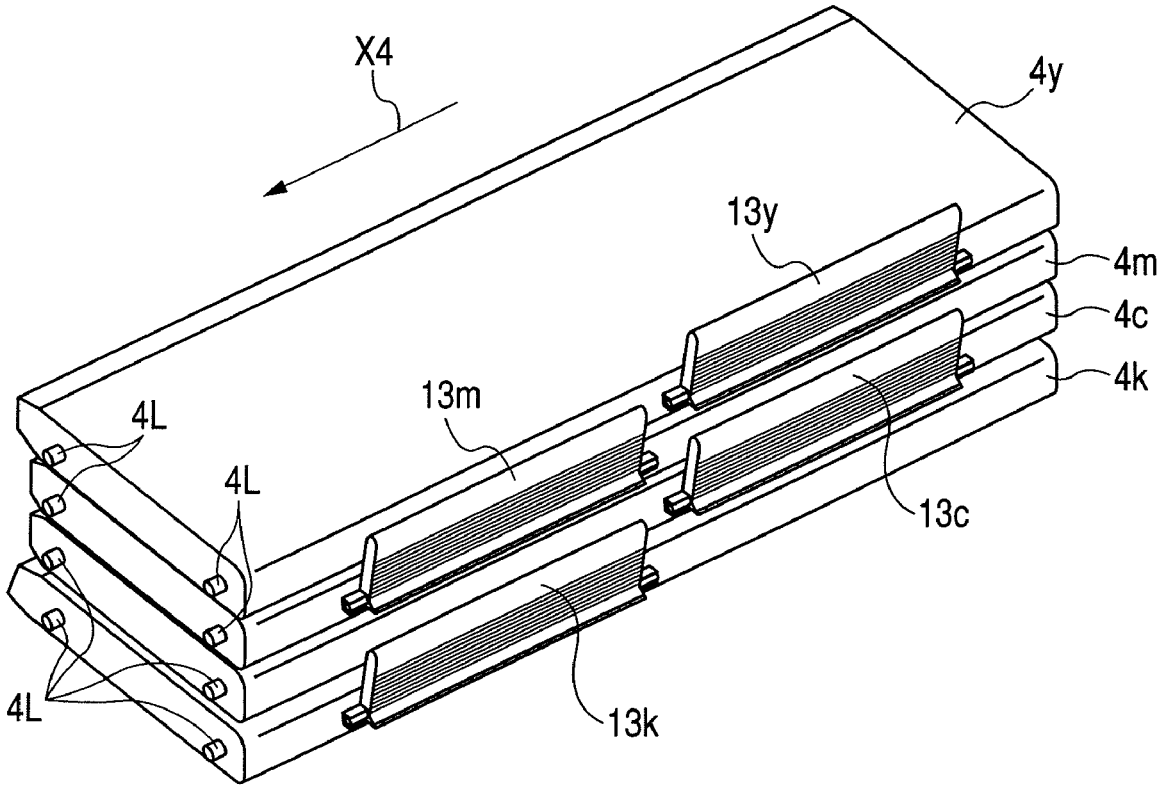
FIG. 16 is a view illustrating an example in which a storage structure example 1 of the cartridge gripping portion illustrated in FIGS. 14A, 14B, 14C and 15 is used in a gripping portion structure illustrated in the structural example 2 of the cartridge gripping portion.
Figure 17:
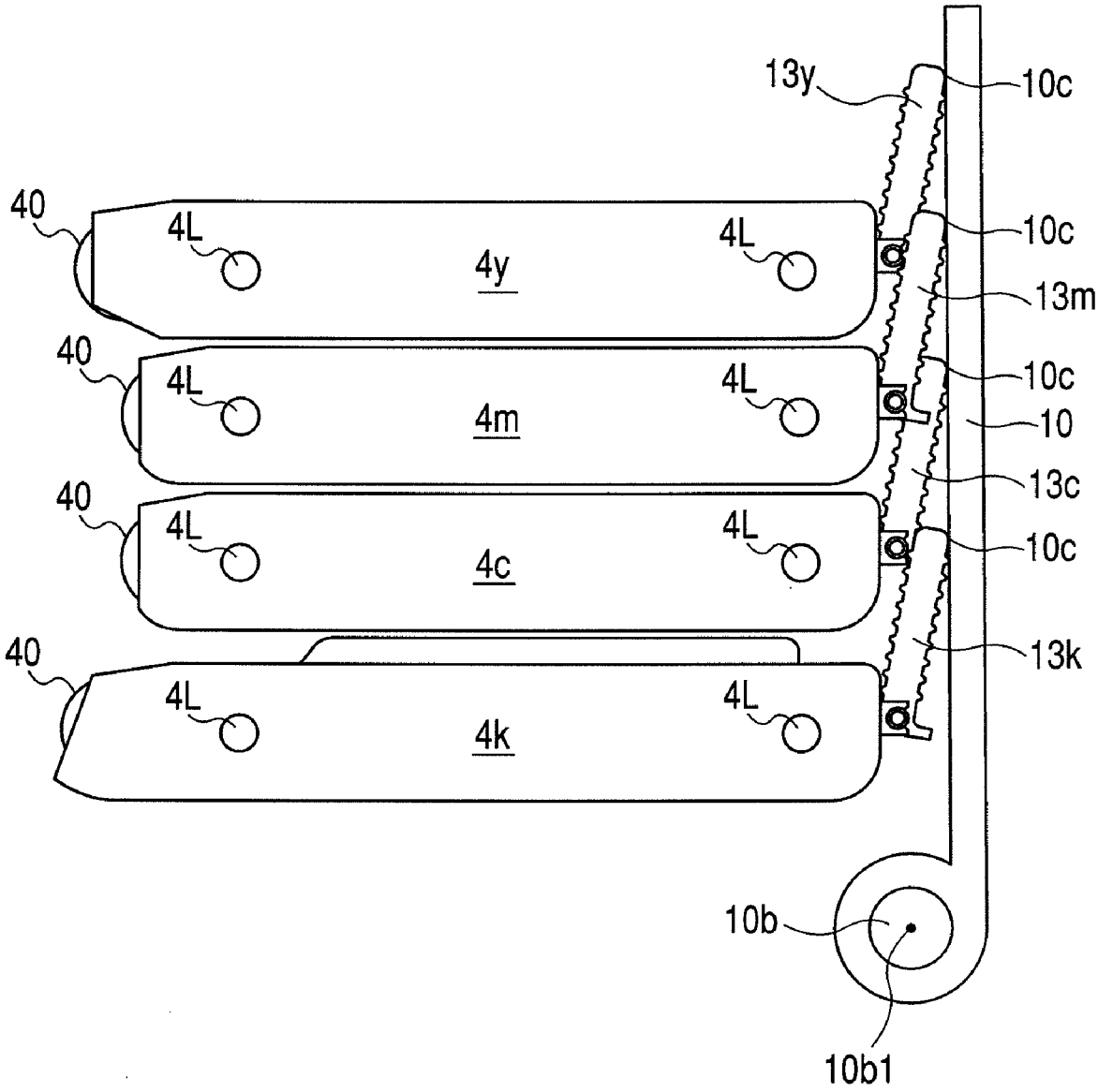
FIG. 17 is a view illustrating the example in which the storage structure example 1 of the cartridge gripping portion illustrated in FIGS. 14A, 14B, 14C and 15 is used in the gripping portion structure illustrated in the structural example 2 of the cartridge gripping portion.

FIGS. 16 and 17 illustrate an example applying the above-mentioned storage structure example 1 of the gripping portions to the gripping portion structure described in the structural example 2 (FIG. 7) of the gripping portions. In the structure of the gripping portions described in the structural example 2, in the X4 direction, the gripping portions 13 do not overlap the gripping portions of the adjacent cartridges. Accordingly, when the gripping portions 13 move from the protruded position to the retracted position, the gripping portions 13 may move without interfering with the adjacent gripping portions. In other words, the gripping portions 13 may further rotate (move) compared with the above-mentioned structural example 1.

As illustrated in FIG. 17, when seen from the arrow X4 direction of FIG. 16, the gripping portions 13 are in such a state that at least a part thereof overlaps the gripping portions of the adjacent cartridges. The gripping portion 13*y* of the yellow cartridge 4*y* partially overlaps the gripping portion

13*m* of the magenta cartridge 4*m*. The gripping portion 13*m* of the magenta cartridge 4*m* partially overlaps the gripping portion 13*y* of the yellow cartridge 4*y* and the gripping portion 13*c* of the cyan cartridge 4*c*. The gripping portion 13*c* of the cyan cartridge 4*c* partially overlaps the gripping portion 13*m* of the magenta cartridge 4*m* and the gripping portion 13*k* of the black cartridge 4*k*, and the gripping portion 13*k* of the black cartridge 4*k* partially overlaps the gripping portion 13*c* of the cyan cartridge 4*c*.

That is, the gripping portions 13 may movable between the protruded position of protruding from the outer surface of the rear end side of the cartridges 4 and the retracted position of being closer to the outer surface than the protrude position. Further, when seen from the X4 direction which is the direction orthogonal to the one direction (vertical direction) and orthogonal to the mounting direction X2 of the cartridges, at least the part of the gripping portions 13 overlap the gripping portions of the adjacent cartridges in the retracted position.

As described above, with the structure in which the gripping portions 13*y*, 13*m*, 13*c* and 13*k* do not overlap the gripping portions of the adjacent cartridges in the arrow X4 direction, and with the structure in which the gripping portions may move, the size in the lateral direction of FIG. 17 may be reduced compared with the above-mentioned storage structure 1.

Further, compared with the above-mentioned storage structure 1, the protruding amount of the gripping portions 13 may be set large. That is, the large protruding amount of the gripping portions 13 has an insignificant effect on the increase in size of the apparatus main body 101 because there is adopted structure in which the gripping portions 13 partially overlap the gripping portions of the adjacent cartridges.

(Color of Cartridge Gripping Portion)

In the above-mentioned structure of all the gripping portions, each of the gripping portions 13*y*, 13*m*, 13*c*, and 13*k* is formed as the same color or the similar color to the color of the developer contained in the cartridge 4 to which each of the gripping portions is attached. That is, the gripping portion 13*y* is yellow, the gripping portion 13*m* is magenta, the gripping portion 13*c* is cyan, and the gripping portion 13*k* is black. By making the color of each of the gripping portions 13 correspond to the color of the contained developer, it is easy for the user to intuitively recognize the color of the gripping cartridge 4. Accordingly, an effect is attained in that the fear of erroneously mounting the cartridges 4 to the apparatus main body 101 is reduced. The same holds for the gripping portions 14*y*, 14*m*, 14*c*, and 14*k* and/or 15*y*, 15*m*, 15*c* and 15*k* illustrated in FIGS. 9, 10, 11, 12 and 13.

Second Embodiment

Figure 18:
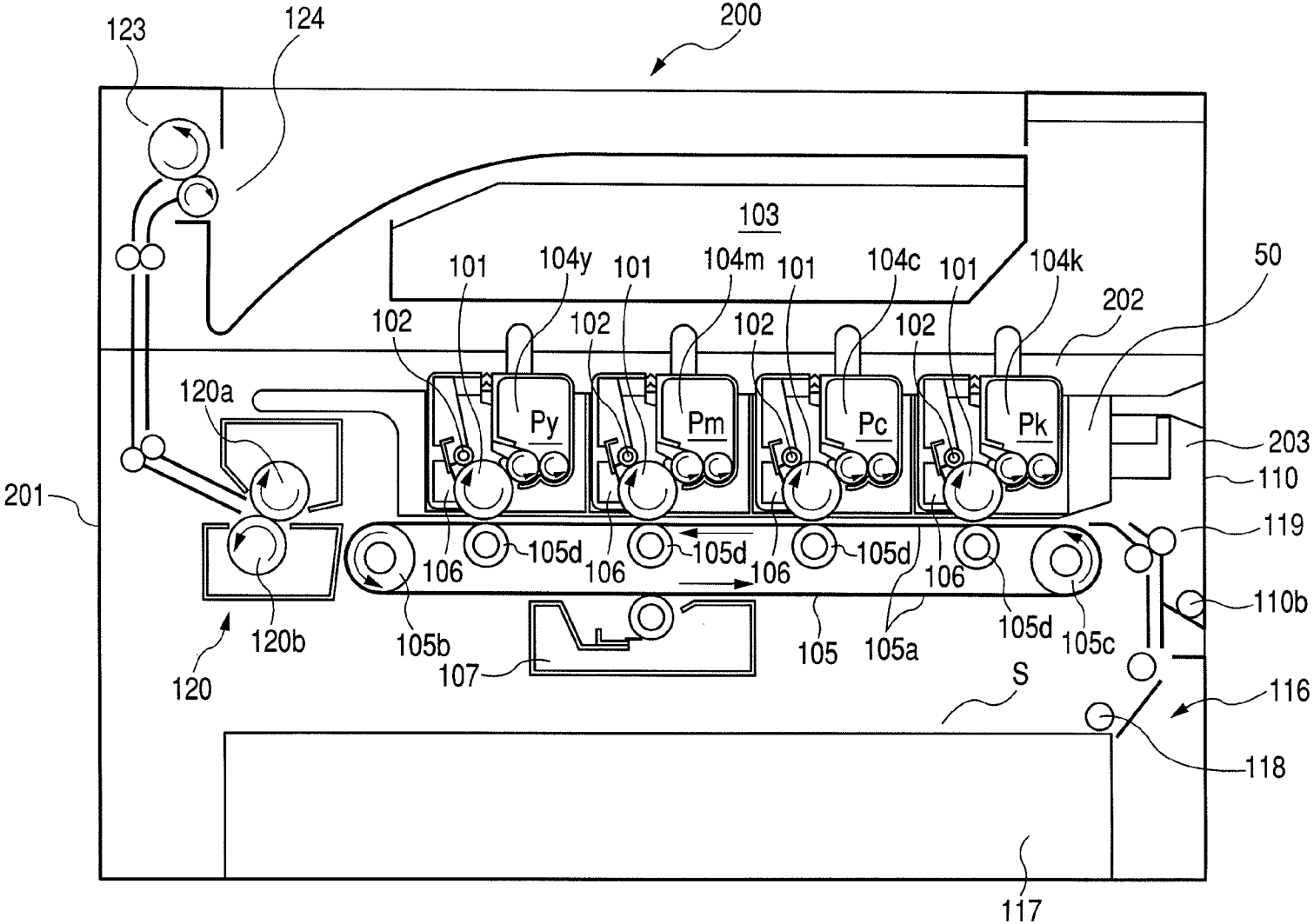
FIG. 18 is a right-side-schematic sectional view of an image forming apparatus according to a second embodiment.

FIG. 18 is a right-side-schematic sectional view of an image forming apparatus 200 according to a second embodiment of the present invention. Similarly to the image forming apparatus 100 according to the first embodiment, the image forming apparatus 200 according to the second embodiment is also a four-full-color laser printer using an electrophotographic process. The image forming apparatus 200 according to the second embodiment is a so-called lateral tandem image forming apparatus in which four process cartridges each forming a toner image of yellow (y), magenta (m), cyan (c) and black (k) color are arranged laterally. Here, the image forming apparatus 200 described in this embodiment is a color electrophotographic image forming apparatus which forms a color image onto a recording medium S in such a state that a plurality of cartridges (104*y*, 104*m*, 104*c* and 104*k*) are detachably mounted adjacently in one direction, that is, in a horizontal direction.

(General Structure)

Regarding the image forming apparatus 200, a forward side or a front side refers to a side on which a door 110 for opening and closing the apparatus is arranged. A rear side refers to an opposite side thereto. A front-and-rear direction refers to a direction from the rear side toward the front side of the image forming apparatus (forward direction), and an opposite direction thereto (backward direction). Left and right refer to left and right as looking from the front side of the image forming apparatus. A lateral direction refers to a direction from right toward left (left-hand direction) and an opposite direction thereto (right-hand direction). Further, an apparatus main body refers to an image forming apparatus portion excluding the cartridges.

Inside an apparatus main body 201, there are horizontally arranged first to fourth, i.e., four process cartridges P (Py, Pm, Pc and Pk) from the rear side to the front side in this order. Each of the process cartridges (hereinafter, referred to as cartridges) P includes an electrophotographic photosensitive drum 101 (hereinafter, referred to as drum) serving as an image bearing member having a latent image formed thereon. The drum 101 is driven to rotate clockwise as indicated by the arrow. Around the drum 101, there are disposed a charging means 102, a developing means 104, and a drum cleaning means 106 in a rotating direction of the drum in this order. A charging roller is used as the charging means 102. The developing means 104 includes a developing roller with respect to the drum 101, a developer applying roller with respect to the developing roller, a developing blade, a developer agitating member, and the like, and serves as a developing unit containing toner as a developer. A blade cleaning device is used as the drum cleaning means 106. In each of the cartridges P, the drum 101, the charging means 102, the developing means 104, and the drum cleaning means 106 are assembled to a cartridge frame, and are mounted to and detached from the apparatus main body 201 so as to be replaceable.

The first cartridge Py contains a toner of yellow color (y-color) as a developer in the developing means 104*y*, and a toner image of y-color is formed on a surface of the drum 101. Hereinafter, the cartridge Py is referred to as a yellow cartridge. The second cartridge Pm contains a toner of magenta color (m-color) as a developer in the developing means 104*m*, and a toner image of m-color is formed on a surface of the drum 101. Hereinafter, the cartridge Pm is referred to as a magenta cartridge. The third cartridge Pc contains a toner of cyan color (c-color) as a developer in the developing means 104*c*, and a toner image of c-color is formed on a surface of the drum 101. Hereinafter, the cartridge Pc is referred to as a cyan cartridge. The fourth cartridge Pk contains a toner of black color (k-color) as a developer in the developing means 104*k*, and a toner image of k-color is formed on a surface of the drum 101. Hereinafter, the cartridge Pk is referred to as a black cartridge.

Above and below each of the cartridges P, there are arranged a laser scanner unit 103 serving as an image exposing means and an electrostatic transfer belt unit 105, respectively. The unit 105 includes an endless electrostatic transfer belt (hereinafter, referred to as belt) 105*a* which is made of a dielectric and has a flexibility. Further, the unit 105 includes a first roller 105*b* on the rear side and a second roller 105*c* on the front side which are wrapped by the belt 105*a* so as to stretch the belt 105*a*. Still further, the unit 105 includes four transferring rollers 105*d* which are disposed between the first roller 105*b* and the second roller 105*c* and are brought into pressure contact with the drums 101 of the cartridges P through an intermediation of the belt 105*a*. In each of the cartridges P, a contact portion between the drum 101 and the belt 105*a* is a transfer nip portion. The first roller 105*b* is driven, whereby the belt 105*a* is driven to rotate counter-clockwise as indicated by the arrow at a speed corresponding to a rotating speed of the drums 101. A cleaning means 107 for removing dirt on the belt is arranged on the lower surface side of the belt 105*a*.

Operations for forming a full-color image are described as follows. Each of the cartridges P (Py, Pm, Pc and Pk) is sequentially driven in accordance with control timing. Due to the drive, each of the drums 101 rotates clockwise as indicated by the arrow. The belt 105*a* of the belt unit 105 is also driven to rotate. The scanner unit 103 is also driven. In each of the cartridges P, in synchronism with the drive, the charging roller 102 uniformly charges the surface of the drum 101 to a predetermined polarity and electric potential. The scanner unit 103 performs scanning and exposing of a laser beam on the surface of each of the drums 101 in response to a corresponding image signal. With this operation, an electrostatic latent image in response to the corresponding image signal is formed on the surface of each of the drums 101. The formed electrostatic latent image is developed as a toner image by the developing means 104.

By means of the electrophotographic process operations as describe above, the toner image of y-color corresponding to a yellow component image of the full-color image is formed on the drum 101 of the yellow cartridge Py. The toner image of m-color corresponding to a magenta component image of the full-color image is formed on the drum 101 of the magenta cartridge Pm. The toner image of c-color corresponding to a cyan component image of the full-color image is formed on the drum 101 of the cyan cartridge Pc. The toner image of k-color corresponding to a black component image of the full-color image is formed on the drum 101 of the black cartridge Pk.

On the other hand, a feeding roller 118 of a feeding portion 116 is driven at predetermined control timing, and one sheet-like recording medium S is separated and fed from a cassette 117 in which the recording medium S is loaded and contained. The cassette 117 is freely taken out and put in from the front side of the apparatus main body 201 (front loading). The fed recording medium S is supplied onto the belt 105*a* of the belt unit 105 from the front side at the predetermined control timing by a registration roller pair 119. The recording medium S supplied onto the belt 105*a* is electrostatically attached to the belt 105*a*, and is sequentially fed, due to the rotation of the belt, to each of the transfer nip portions of the black cartridge Pk, the cyan cartridge Pc, the magenta cartridge Pm, and the yellow cartridge Py. With this operation, unfixed full-color toner image of four color having k-color+c-color+m-color+y-color is synthesized and formed on the recording medium S.

Then, the recording medium S is separated from the surface of the belt 105*a*, and is introduced to a fixing portion 120. The fixing portion 120 performs fixing (fusion color-mixture fixing) of the toner image of a plurality of colors transferred onto the recording medium S. The fixing portion 120 includes a rotating heating roller 120*a* and a pressure roller 120*b* which is brought into pressure contact with the heating roller 120*a* so as to apply heat and pressure to the recording medium S. When passing the fixing portion 120, the recording medium S on which the toner image is formed is nipped and conveyed by the fixing roller pair 120*a* and 120*b*. Heat and pressure are applied by the fixing roller pair 120*a* and 120*b*. With this operation, the toner image of the plurality of colors is fixed onto the surface of the recording medium S. Then, the recording medium S gets out of the fixing portion 120, and is delivered as the full-color image formation product outside the apparatus main body from a delivery portion 124 by a delivery roller pair 123.

In a case of a monochrome image forming mode, the image formation using only the black cartridge Pk is performed.

(Cartridge Replacement System)

Each of the cartridges P (Py, Pm, Pc and Pk) may be replaced when the toner is consumed to finish lifetime thereof with the result of use by the user. In the image forming apparatus of this embodiment, as to replacement of the cartridges, there is adopted, for the purpose of improving usability, a system in which the cartridges are placed on a pullout member 50 which is a drawer-type frame-like member serving as a moving member, and are replaced by front access.

On the front side of the apparatus main body 201, there is provided an opening portion 203 in which the cartridges are pushed into the inside of the apparatus main body 201, or in which the pullout member 50 passes through when the cartridges are pulled out from the apparatus main body 201. The rotatable door 110 is arranged on the front side of the apparatus main body 201. The door 110 is an openable and closable member which may be positioned at a closed position for closing the opening portion 203 and an open position for opening the opening portion 203. In this embodiment, the door 110 rotates about a hinge portion 10*b* of the lower side of the door so as to be openable and closable with respect to the apparatus main body 201. That is, the door 110 rotates about the hinge portion 10*b* in a vertically-raising direction, and may cause the opening portion 203 of the apparatus main body 201 to be in the closed state as illustrated in FIG. 18. Further, the door 110 rotates about the hinge portion 10*b* so as to lean toward the front of the apparatus main body 201, and may cause the opening portion 203 to be in the open state as illustrated in FIG. 19.

The pullout member (moving member) 50 is guided by a guide member (not shown) with respect to the apparatus main body 201, and is provided so as to be capable of moving (being pushed in/pulled out) in directions of the arrows D1 and D2, which are substantially horizontal directions.

Figure 19:
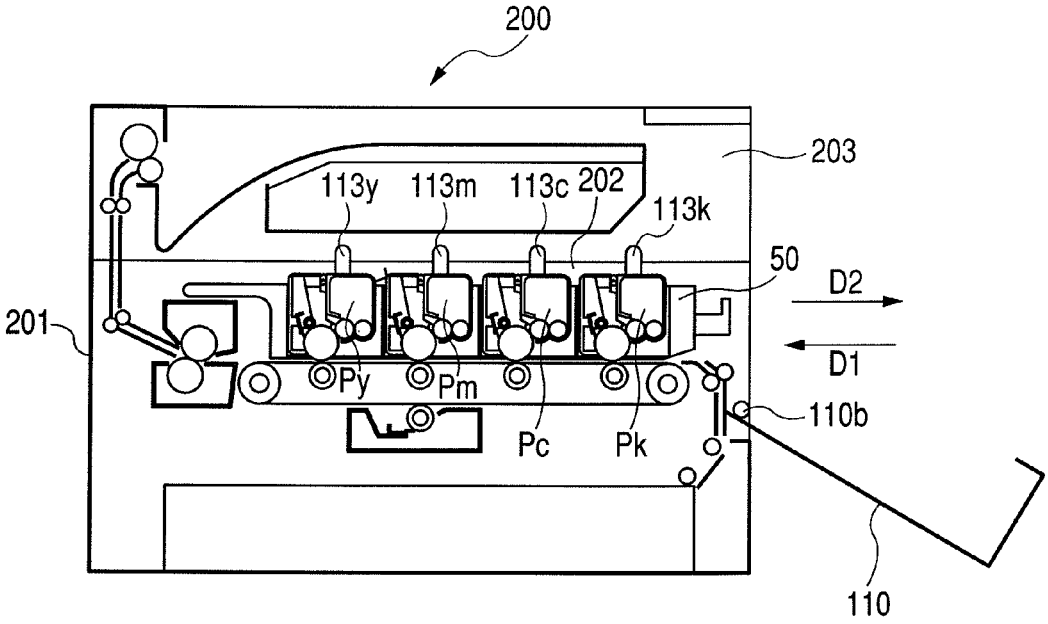
FIG. 19 is a view of the image forming apparatus with a door being opened.
Figure 20:
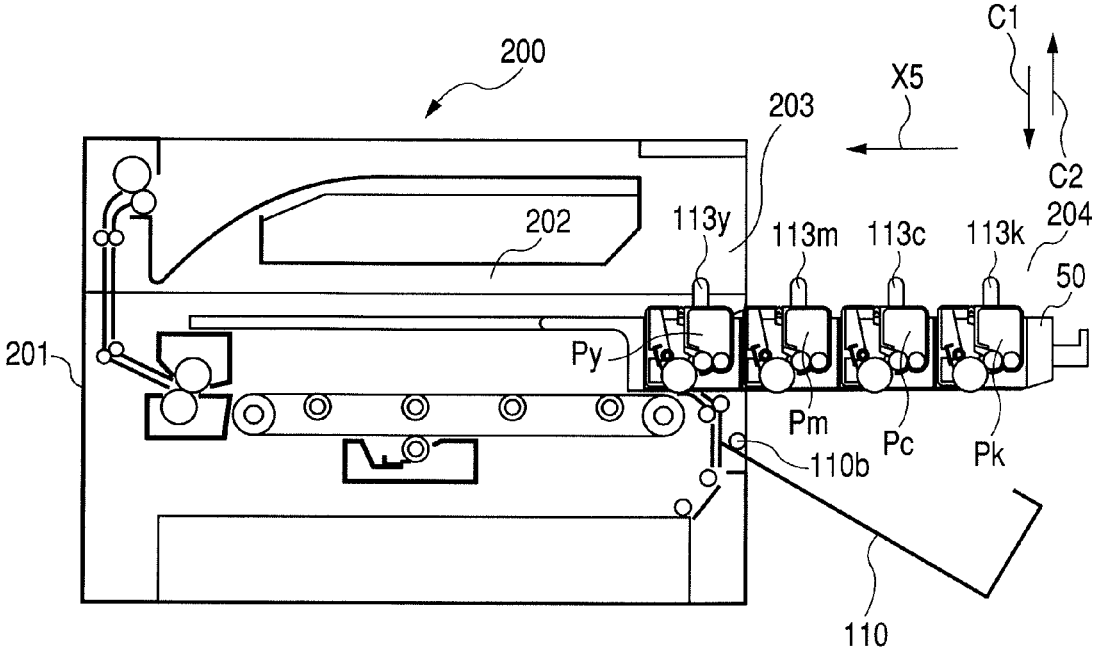
FIG. 20 is a view of the image forming apparatus in which a pullout member further holding the cartridges is pulled out to a pullout position.
Figure 21:
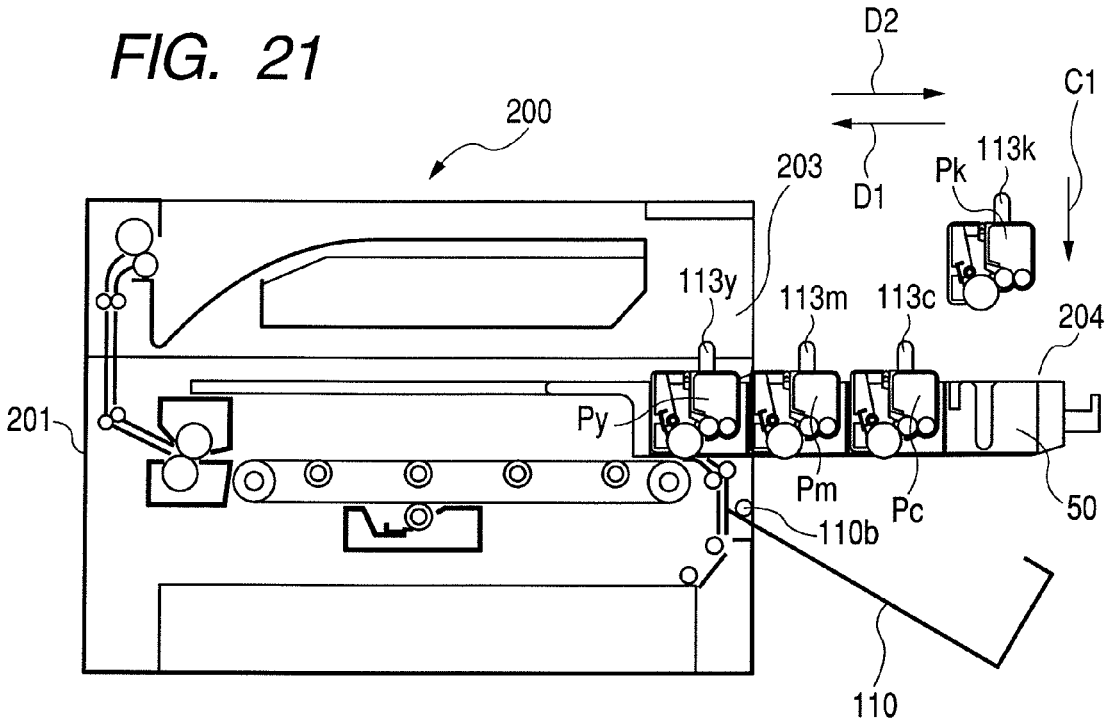
FIG. 21 is a view illustrating how the cartridge is mounted to the apparatus main body.

Further, the pullout member 50 may be positioned at a mounting position (inside position) 202 inside the apparatus main body 201 as illustrated in FIGS. 18 and 19 and a pullout position (outside position) 204 in which the pullout member 50 is pulled out from the mounting position as illustrated in FIGS. 20 and 21.

Note that, the mounting position (inside position) 202 is a position in which the pullout member 50 is positioned inside the apparatus main body 201. Further, the pullout position (outside position) 204 is a position in which the pullout member 50 is positioned outside the apparatus main body 201.

Further, as illustrated in FIG. 21, in such a state that the pullout member 50 is positioned at the pullout position 204, the cartridges P (Py, Pm, Pc and Pk) are mounted to the pullout member 50 in a substantially gravity direction of the arrow C1, which is a mounting and detaching direction with respect to the apparatus main body 201.

With being retained in the pullout member 50, the cartridges P (Py, Pm, Pc and Pk) enter the apparatus main body 201 together with the pullout member 50.

Therefore, the user causes the pullout member 50 to enter the apparatus main body 201, and closes the door 110, thereby making it possible to reliably mount the cartridges P to the apparatus main body 201. Thus, regarding structure in which the user individually mounts the cartridges P into the apparatus main body 201, operability is improved.

FIG. 21 illustrates how the cartridge P is mounted to the apparatus main body 201. The user performs mounting operation of the cartridge P to the apparatus main body 201 when newly using the apparatus main body or replacing the used cartridge to a new cartridge P.

First, the user opens the door (openable and closable member) 110, and pulls out the pullout member 50 to the pullout position 204 through the opening portion 203. Further, the user grips by hand gripping portions 113 (113*y*, 113*m*, 113*c*, and 113*k*) protruding from outer surfaces of the cartridges P, and mounts the cartridges to the pullout member 50 which is a part of the apparatus main body 201. Note that, the door 110 opens and closes the opening portion 203.

FIG. 20 illustrates a state in which all the cartridges Py, Pm, Pc and Pk are mounted in the pullout member 50. The cartridges P are adjacently arranged in one direction (in this embodiment, horizontal direction: arrow X5).

When the cartridge P outlives its usefulness, the user performs detaching operation of the cartridge from the apparatus main body 201. The detaching operation is performed by the procedure reverse to the above-mentioned procedure for mounting. That is, the user opens the door 110 (FIG. 19), pulls out the pullout member 50 to the pullout position 204 (FIG. 20), and grips by hand the gripping portion 113 of the cartridge P to be replaced thereby to detach the cartridge outside the apparatus main body (FIG. 21). In this case, the detaching direction (arrow C2) of the cartridge P is opposite to the mounting direction (arrow C1), and the cartridge P is detached from the pullout member 50 in an approximately vertical direction (perpendicular direction). The mounting and detaching direction of the cartridge P indicates the above-mentioned mounting direction and detaching direction. Note that, in this embodiment, the pullout member (moving member) 50 moves in the horizontal direction with respect to the installation surface (not shown) on which the image forming apparatus 200 is installed, and are positioned at the pullout position 204.

Note that, in this embodiment, the mounting direction in which the cartridge P is mounted to the apparatus main body 201 is the direction in which the cartridge P is mounted to the pullout member (moving member) 50.

In this case, the pullout member 50 may move linearly, and may be positioned at the inside position and the outside position with respect to the apparatus main body 201. In the state in which the pullout member 50 is positioned at the outside position, there is performed mounting and detaching operation of the cartridge P with respect to the pullout member 50. Further, in the state in which the pullout member 50 is positioned at the inside position, the cartridge P may perform image formation.

According to this embodiment, in the mounting direction (vertical direction) in which the cartridges P are mounted to the apparatus main body 201, each of the cartridges P is arranged on the rear end side of each of the cartridges P, and protrudes from the rear end side thereof toward the upstream side of the mounting direction.

Note that, in this embodiment, the pullout member (moving member) 50 linearly moves in the horizontal direction with respect to the installation surface (not shown) on which the image forming apparatus 200 is installed. However, the pullout member (moving member) 50 is not limited to this structure, and may linearly move obliquely upward or obliquely downward with respect to the installation surface (not shown) on which the image forming apparatus 200 is installed.

As described above, each of the cartridges P is provided with the gripping portion 113, and hence the user grips the gripping portion 113 by hand. As a result, it is possible to perform mounting and detaching operation of the cartridges P with respect to the pullout member 50 which is a part of the apparatus main body 201.

(Structural Example 1 of Cartridge Gripping Portion)

Figure 22:
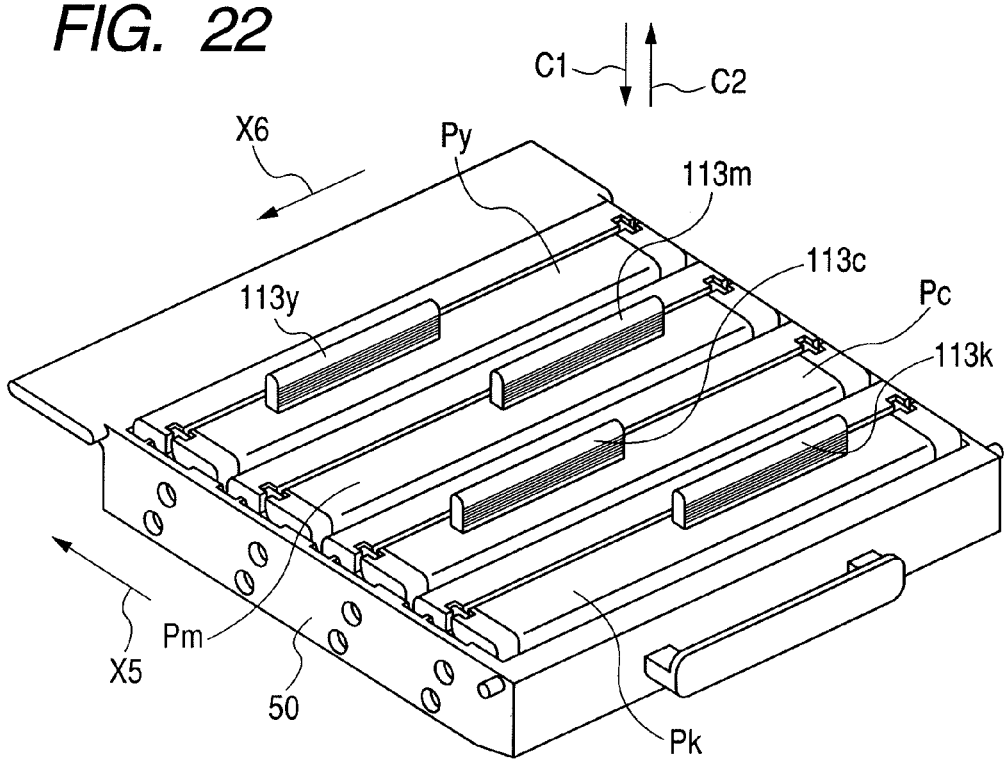
FIG. 22 is a perspective view of a plurality of cartridges, gripping portions thereof, and the pullout member having the cartridges mounted thereon.

FIG. 22 is a perspective view of the cartridges Py, Pm, Pc, and Pk, the gripping portions 113 (113*y*, 113*m*, 113*c*, and 113*k*), and the pullout member 50 mounted with the cartridges P. The other structure of the apparatus main body is omitted.

As illustrated in FIG. 22, the gripping portions 113 (113*y*, 113*m*, 113*c* and 113*k*) of the cartridges Py, Pm, Pc and Pk are disposed out of line with the gripping portions 113 of the cartridges P adjacent to each other. That is, the gripping portion 113*y* provided to the yellow cartridge Py is disposed out of line with the gripping portion 113*m* provided to the adjacent magenta cartridge Pm. Similarly, the gripping portion 113*c* provided to the cyan cartridge Pc is disposed out of line with the gripping portion 113*m* and the gripping portion 113*k* respectively provided to the magenta cartridge Pm and the black cartridge Pk adjacent. The gripping portion 113*k* provided to the black cartridge Pk is disposed out of line with the gripping portion 113*c* provided to the adjacent cyan cartridge Pc. The direction in which the gripping portions are disposed out of line with each other (arrow X6) is orthogonal to the above-mentioned one direction in which the plurality of the cartridges P are adjacent to each other (arrow X5), and to the mounting and detaching direction of the cartridges (arrows C1 and C2).

As described above, each of the gripping portions 113 is disposed out of line with the gripping portions of the adjacent cartridges in the direction of the arrow X6. Thus, when the user grips any one of the gripping portions 113 of the cartridges P, it is unlikely that the gripping portions of the adjacent cartridges become obstacles, whereby it is possible to easily hold the gripping portion.

Figure 23:
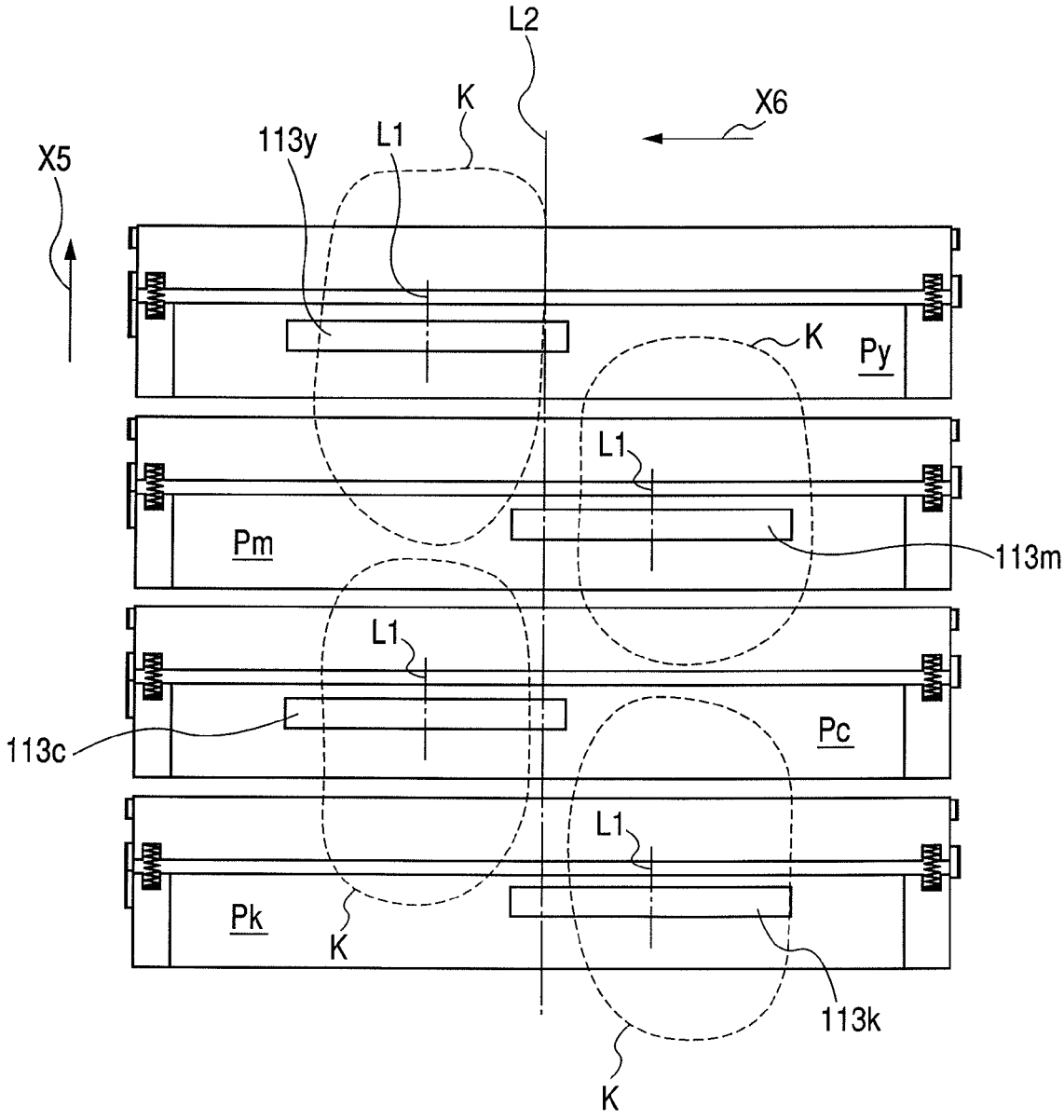
FIG. 23 is a view of cartridge gripping portions of a structural example 1.

FIG. 23 is a top view of the cartridges Py, Pm, Pc, and Pk of FIG. 22. Each of the gripping portions 113 of the cartridges P is disposed out of line with each other. Thus, spaces k are formed in the direction of the arrow X5 of each of the gripping portions 113. When the user holds any one of the gripping portions 113 of the cartridges P, the user may put his/her hand into one of the spaces k, thereby easily holding the gripping portion 113.

Further, a longitudinal center line L1 of each of the gripping portions 113 does not overlap the adjacent gripping portions 113. Therefore, when it is considered that the user grips the gripping portion 113 at substantially the center thereof, the user grips the gripping portion 113 more easily when compared to the case in which the gripping portions 113 are solely disposed out of line with each other.

Further, as illustrated in FIG. 23, each of the gripping portions 113 is arranged so as to overlap a longitudinal center line L2 of each of the cartridges P. Therefore, when assuming that a center of gravity of each of the cartridges P is in the vicinity of approximately the longitudinal center thereof, each of the gripping portions 113 is arranged so as not to be largely separated from the center of gravity of each of the cartridges P. Thus, it is unlikely that the cartridge P inclines due to the weight of the cartridge P when the user grips the gripping portion 113.

(Structural Example 2 of Cartridge Gripping Portion)

Figure 24:
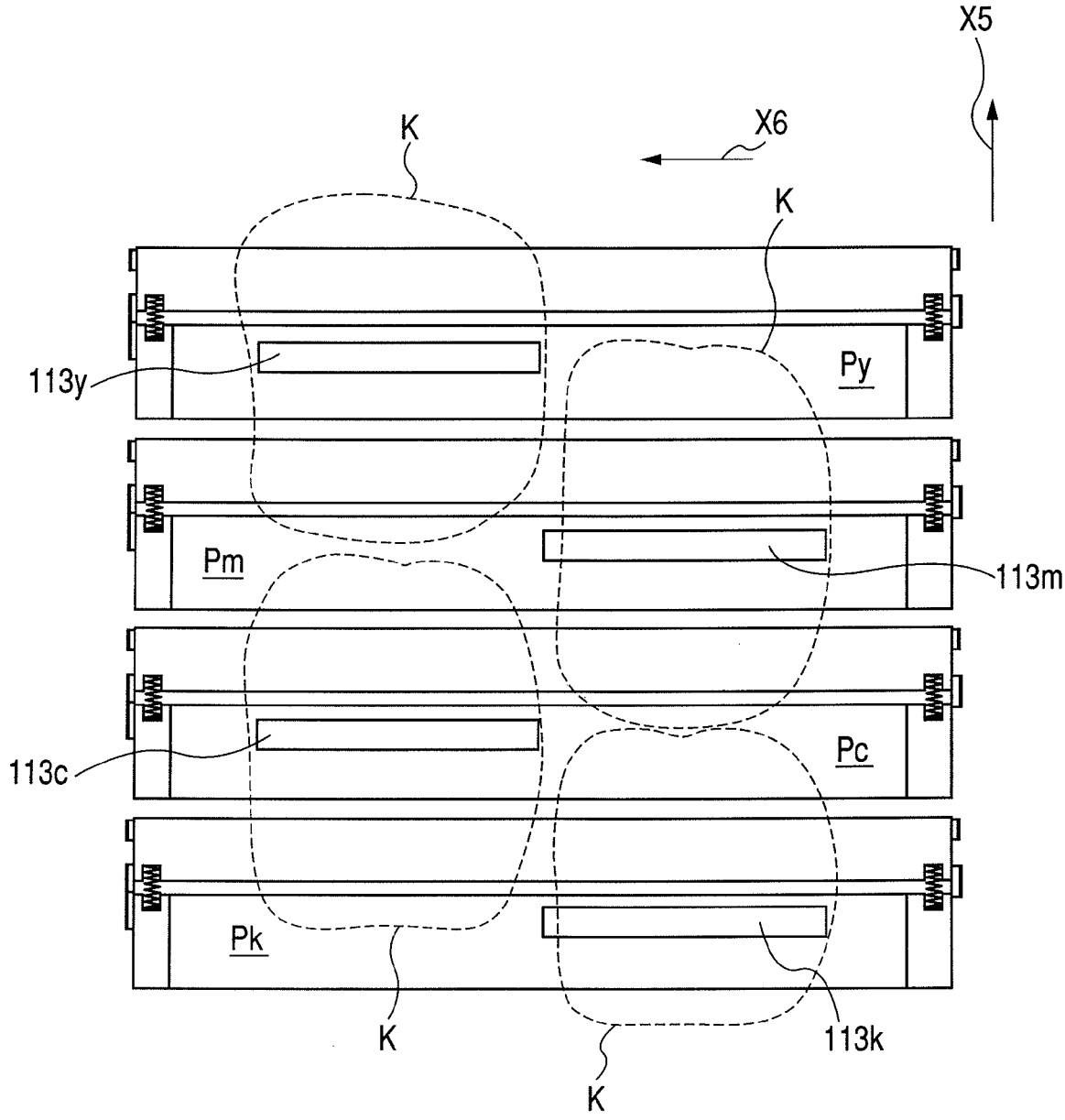
FIG. 24 is a view of cartridge gripping portions of a structural example 2.

FIG. 24 illustrates an example in which, unlike the structural example 1 (FIG. 23) of the gripping portions of the cartridges, the gripping portions 113 are further displaced in the direction of the arrow X6. In this example, in the X6 direction, each of the gripping portions 113*y*, 113*m*, 113*c* and

113*k* does not overlap the gripping portions of the adjacent cartridges. Therefore, when compared to the above-mentioned structural example 1, the user may grip the gripping portion 113 more easily. That is, the spaces k in the direction of the arrow X5 become wider in the direction of the arrow X6 than the spaces k of the structural example 1, and hence the user holds the cartridge P more easily than that of the structural example 1.

(Structural Example 3 of Cartridge Gripping Portion)

Figure 25:
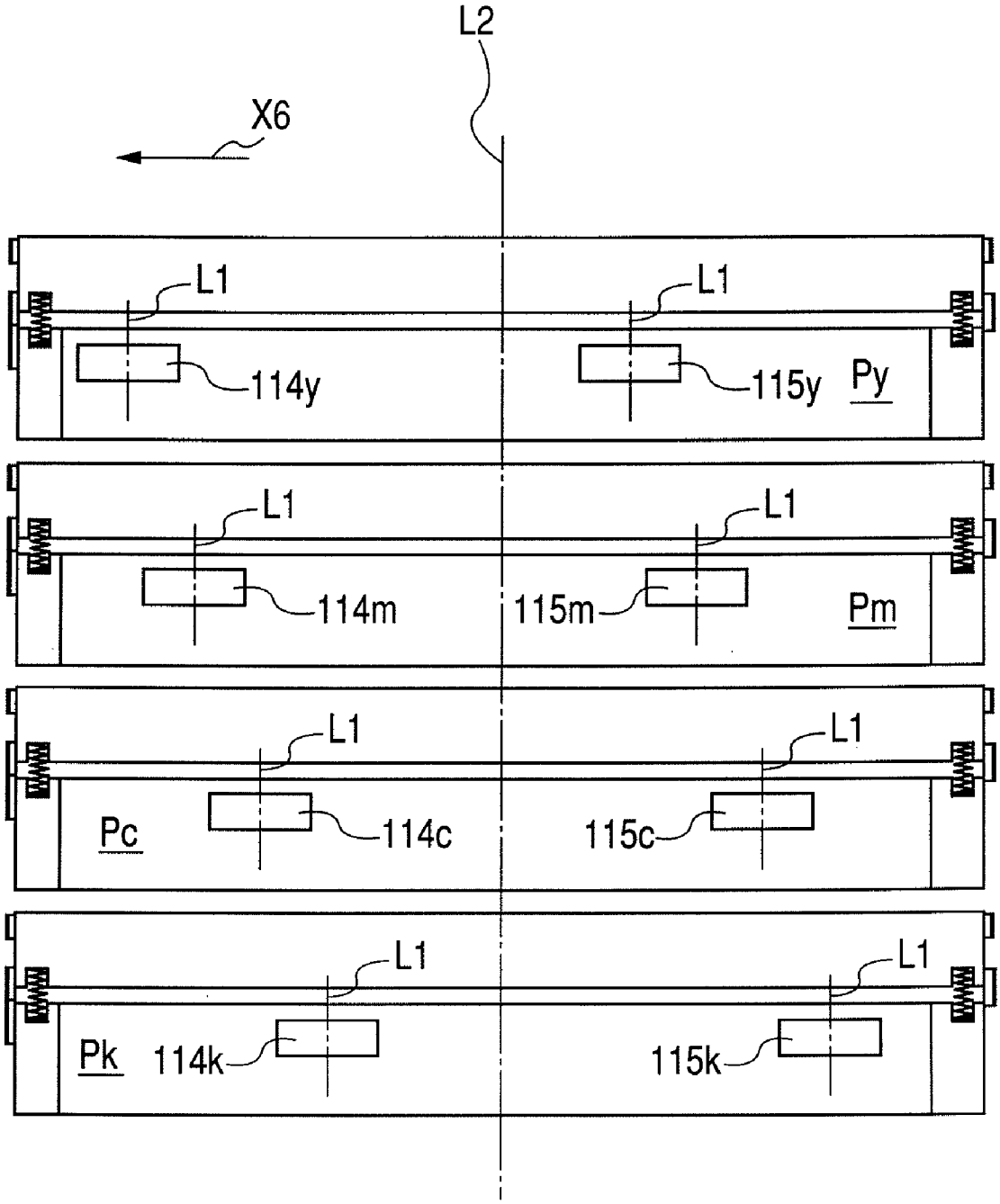
FIG. 25 is a view of cartridge gripping portions of a structural example 3.

FIG. 25 illustrates an example in which, unlike the structural example 1 (FIG. 23) and the structural example 2 (FIG. 24) of the gripping portions, two gripping portions are provided to each of the cartridges P. The user grips by both hands first gripping portions 114 (114*y*, 114*m*, 114*c* and 114*k*) provided on one end portion of left and right sides of each of the cartridges P and second gripping portions 115 (115*y*, 115*m*, 115*c*, and 115*k*) provided on the other end portion of left and right sides of each of the cartridges P. With this operation, the user performs mounting and detaching operation of the cartridges P. The user may hold the cartridge P by both hands, and hence the user may easily hold the same in a stable manner when compared to the case of operation with one hand (structural examples 1 and 2).

Regarding the first gripping portions 114 and the second gripping portions 115 in this case, similarly to the structural example 1 and the structural example 2, each of the gripping portions 114 and 115 is also disposed out of line with the gripping portions of the adjacent cartridges in the X6 direction. Thus, when the user grips any one of the gripping portions 114 and any one of the gripping portions 115, it is unlikely that the gripping portions of the adjacent cartridges become obstacles, whereby it is possible to easily hold the gripping portions 114 and 115.

Further, the longitudinal center line L1 of each of the gripping portions 114 and 115 does not overlap the adjacent gripping portions 114 and 115. Therefore, when it is considered that the user grips the gripping portion 114 and the gripping portion 115 at substantially the center thereof, the user grips the gripping portion 114 and the gripping portion 115 more easily when compared to the case in which the gripping portions 114 and the gripping portions 115 are solely disposed out of line with each other.

Further, as illustrated in FIG. 25, each of the gripping portions 114 and 115 is provided so as to put the longitudinal center line L2 of each of the cartridges P between the gripping portion 114 and the gripping portion 115. Therefore, when assuming that the center of gravity of each of the cartridges P is in the vicinity of approximately the longitudinal center thereof, the user may grip the cartridge P on both sides thereof putting the center of gravity therebetween, whereby it is possible to stably hold the cartridge P.

(Structural Example 4 of Cartridge Gripping Portion)

Figure 26:
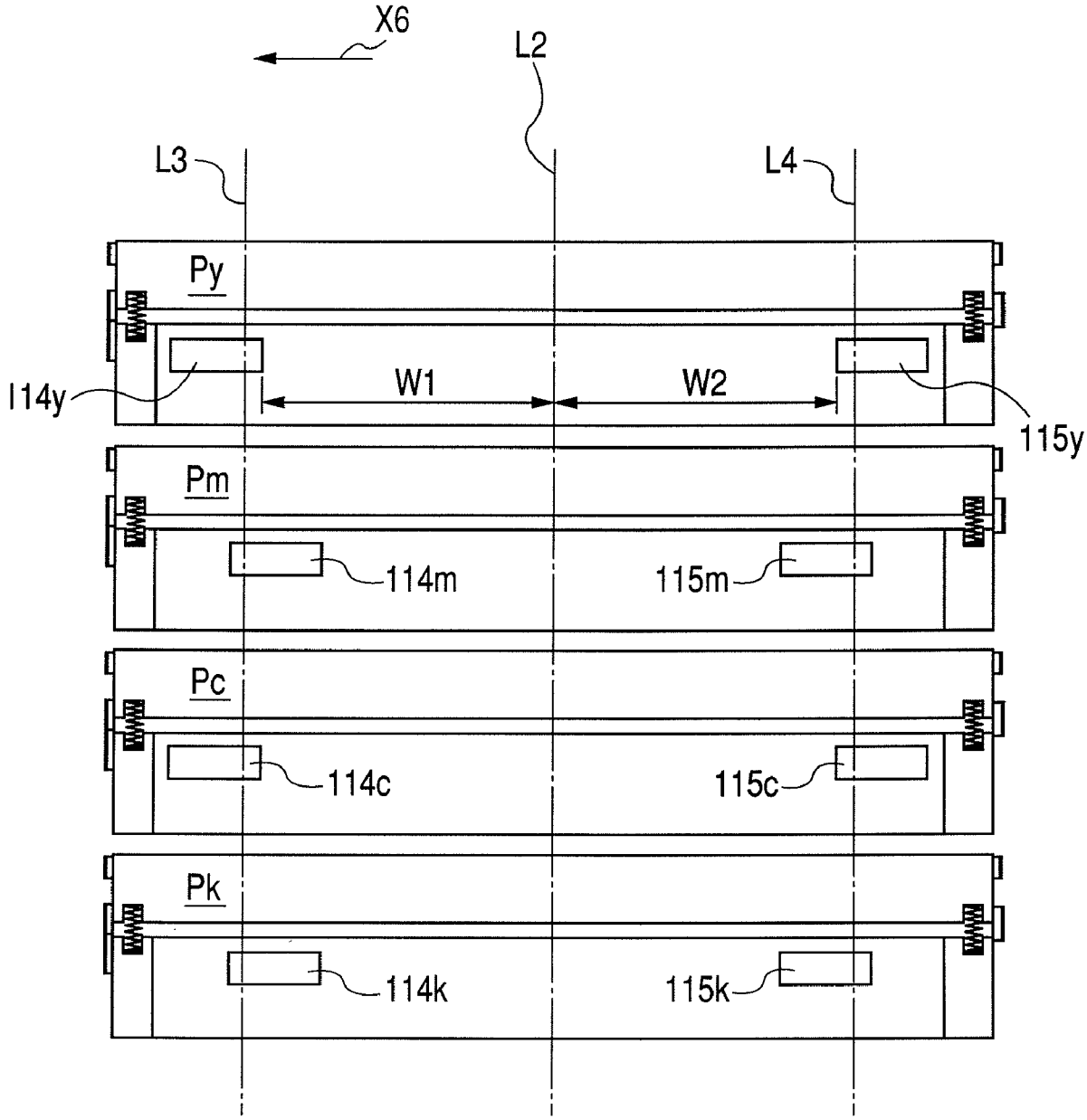
FIG. 26 is a view of cartridge gripping portions of a structural example 4.

FIG. 26 illustrates an example in which, unlike the structural example 3 (FIG. 25) of the cartridge gripping portions, the first gripping portions 114 and the second gripping portions 115 are arranged at equal distances while putting the center line L2 of each of the cartridges P. A distance W1 from the center L2 of the yellow cartridge Py to the first gripping portion 114*y* is equal to a distance W2 from the center L2 to the second gripping portion 115*y*. A distance from the center L2 of the magenta cartridge Pm to the first gripping portion 114*m* is equal to a distance from the center L2 to the second gripping portion 115*m*. A distance from the center L2 of the cyan cartridge Pc to the first gripping portion 114*c* is equal to a distance from the center L2 to the second gripping portion 115*c*. A distance from the center L2 of the black cartridge Pk to the first gripping portion 114*k* is equal to a distance from the center L2 to the second gripping portion 115*k*.

Therefore, when assuming that the center of gravity of each of the cartridges P is in the vicinity of approximately the longitudinal center thereof, the user may grip the gripping portion 114 and the gripping portion 115 at positions away from the center of gravity by approximately the equal distance. Accordingly, it is possible to hold the cartridge P more stably.

Further, each of the first gripping portions 114 is provided so as to be placed alternately with the adjacent gripping portions while putting a center line L3 in the direction of arrow X6 therebetween. Further, each of the second gripping portions 115 is provided so as to be placed alternately with the adjacent gripping portions while putting a center line L4 in the direction of arrow X6 therebetween. Therefore, it is possible to grip the cartridge P at both ends thereof, thereby enabling to hold the cartridge P stably.

As described above, in this embodiment, in the image forming apparatus having the lateral tandem structure, there are described the examples in which the cartridges P are mounted in the pullout member 50. In this embodiment, as the cartridge P, there is exemplified the process cartridge which integrally contains the photosensitive drum, the developing roller, and the developer. However, the cartridge P is not limited thereto, and a developing cartridge which integrates the developing roller and the developer, a toner cartridge which integrates the developer and a container therefor, or the like is also applicable as the cartridge P.

Further, the structure of the structural examples 3 (FIG. 8), 6 (FIG. 11), 7 (FIG. 12), 8 (FIG. 13), etc. of the gripping portions described in the first embodiment may be also used.

Third Embodiment

Figure 27:
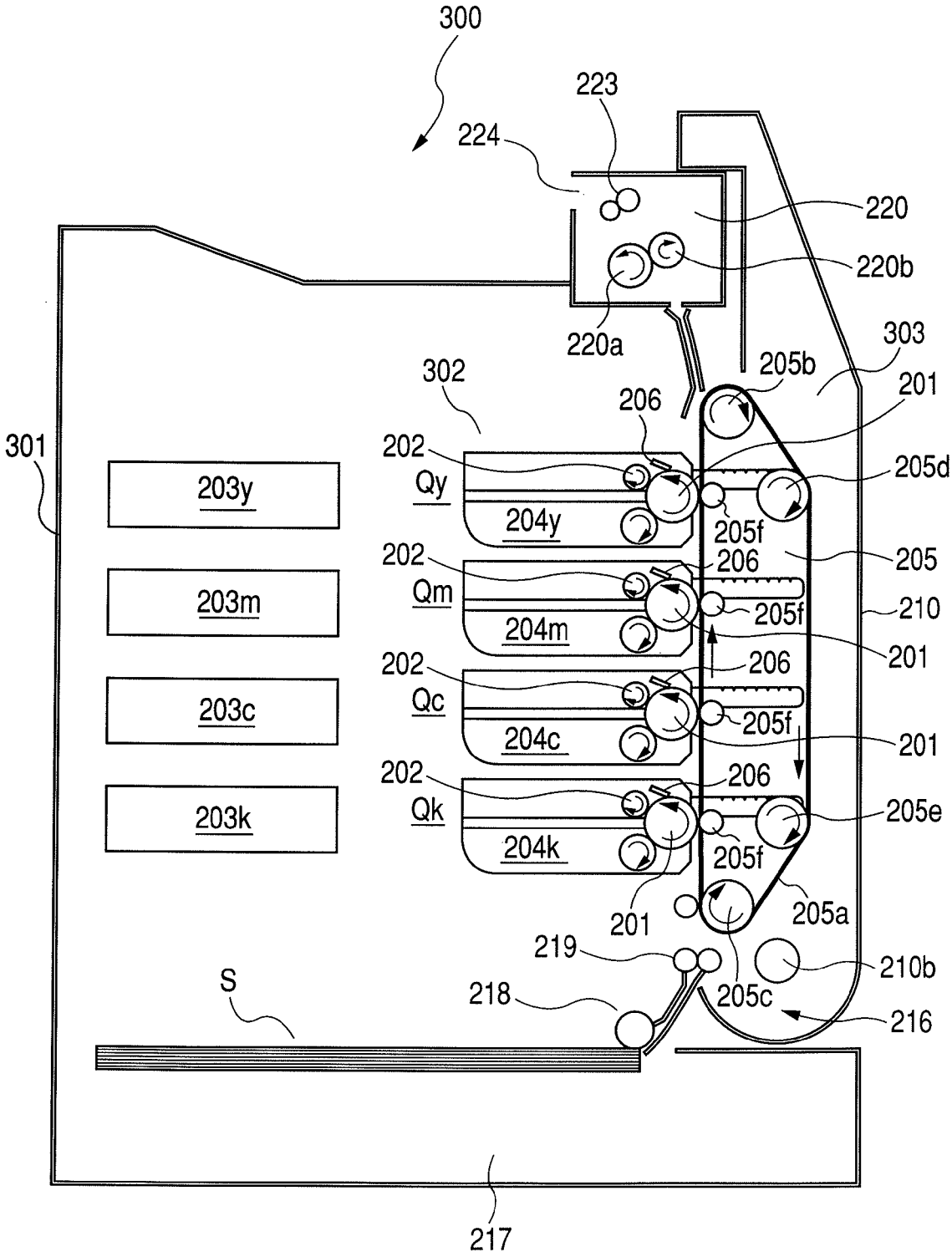
FIG. 27 is a right-side-schematic sectional view of an image forming apparatus according to a third embodiment.

FIG. 27 is a cross-sectional, right-hand side view schematically illustrating an image forming apparatus 300 according to a third embodiment of the present invention. Similarly to the image forming apparatuses 100 and 200 according to the first and second embodiment, the image forming apparatus 300 according to the third embodiment is also a four-full-color laser printer using an electrophotographic process. However, the image forming apparatus 300 according to the third embodiment is a so-called longitudinal tandem image forming apparatus in which four process cartridges each forming a toner image of yellow (y), magenta (m), cyan (c) and black (k) color are arranged longitudinally.

(General Structure)

Regarding the image forming apparatus 300, a forward side or a front side refers to a side on which a door (openable and closable member) 210 is arranged. A rear side refers to an opposite side thereto. A front-and-rear direction refers to a direction from the rear side toward the front side of the image forming apparatus (forward direction), and an opposite direction thereto (backward direction). Right and left refer to right or left when seen from the forward side of the apparatus main body. A lateral direction refers to a direction from right toward left (left-hand direction) and an opposite direction thereto (right-hand direction). Further, an apparatus main body refers to an image forming apparatus portion excluding the cartridges.

Inside an apparatus main body 301, there are vertically arranged first to fourth, i.e., four process cartridges Q (Qy, Qm, Qc and Qk) from the upper side to the lower side in this order.

Each of the process cartridges (hereinafter, referred to as cartridges) Q includes an electrophotographic photosensitive drum 201 (hereinafter, referred to as drum) having a latent image formed thereon. The drum 201 is driven to rotate counterclockwise as indicated by the arrow. Around the drum 201, there are arranged a charging means 202, a developing means 204, and a drum cleaning means 206, which serve as process means acting on the drum, in a rotating direction of the drum in this order. A charging roller is used as the charging means 202. The developing means 204 includes a developing roller with respect to the drum 201, a developer applying roller with respect to the developing roller, a developing blade, a developer agitating member, and the like, and serves as a developing unit containing toner as a developer. A blade cleaning device is used as the drum cleaning means 206. In each of the cartridges Q, the drum 201, the charging means 202, the developing means 204, and the drum cleaning means 206 are assembled to a cartridge frame, and are mounted to and detached from the apparatus main body 301 so as to be replaceable.

The first cartridge Qy contains a toner of yellow color (y-color) as a developer in the developing means 204*y*, and a toner image of y-color is formed on a surface of the drum 201. Hereinafter, the cartridge Qy is referred to as a yellow cartridge. The second cartridge Qm contains a toner of magenta color (m-color) as a developer in the developing means 204*m*, and a toner image of m-color is formed on a surface of the drum 201. Hereinafter, the cartridge Qm is referred to as a magenta cartridge. The third cartridge Qc contains a toner of cyan color (c-color) as a developer in the developing means 204*c*, and a toner image of c-color is formed on a surface of the drum 201. Hereinafter, the cartridge Qc is referred to as a cyan cartridge. The fourth cartridge Qk contains a toner of black color (k-color) as a developer in the developing means 204*k*, and a toner image of k-color is formed on a surface of the drum 201. Hereinafter, the cartridge Qk is referred to as a black cartridge.

On the rear side and the front side of each of the cartridges Q, there are arranged a laser scanner unit 203 (203*y*, 203*m*, 203*c* and 203*k*) serving as an image exposing means and an electrostatic transfer belt unit 205, respectively. The unit 205 includes an endless electrostatic transfer belt (hereinafter, referred to as belt) 205*a* which is made of a dielectric and has a flexibility. Further, the unit 205 includes a first roller 205*b* on the upper side, a second roller 205*c* on the lower side, and two auxiliary rollers 205*d* and 205*e* which are wrapped by the belt 205*a* so as to stretch the belt 205*a*. Still further, the unit 205 includes four transferring rollers 205*f* which are disposed between the first roller 205*b* and the second roller 205*c* and are brought into pressure contact with the drums 201 of the cartridges Q through an intermediation of the belt 205*a*. In each of the cartridges Q, a contact portion between the drum 201 and the belt 205*a* is a transfer nip portion. The first roller 205*b* is driven, whereby the belt 205*a* is driven to rotate clockwise as indicated by the arrow at a speed corresponding to a rotating speed of the drum 201.

Operations for forming a full-color image are described as follows. Each of the cartridges Q is sequentially driven in accordance with predetermined control timing. Due to the drive, each of the drums 201 rotates clockwise as indicated by the arrow. The belt 205*a* of the unit 205 is also driven to rotate. The scanner units 203 are also driven. In each of the cartridges Q, in synchronism with the drive, the charging roller 202 uniformly charges the surface of the drum 201 to a predetermined polarity and electric potential. Each of the scanner units 203 performs scanning and exposing of a laser beam on the surface of each of the drums 201 in response to a corresponding image signal. With this operation, an electrostatic latent image in response to the corresponding image signal is formed on the surface of each of the drums 201. The formed electrostatic latent image is developed as a toner image by the developing means 204.

By the electrophotographic process operations as describe above, the toner image of y-color corresponding to a yellow component image of the full-color image is formed on the drum 201 of the yellow cartridge Qy. The toner image of m-color corresponding to a magenta component image of the full-color image is formed on the drum 201 of the magenta cartridge Qm. The toner image of c-color corresponding to a cyan component image of the full-color image is formed on the drum 201 of the cyan cartridge Qc. The toner image of k-color corresponding to a black component image of the full-color image is formed on the drum 201 of the black cartridge Qk.

On the other hand, a feeding roller 218 of a feeding portion 216 is driven at predetermined control timing, and one sheet-like recording medium S is separated and fed from a cassette 217 in which the recording medium S is loaded and contained. The cassette 217 is freely taken out and put in from the front side of the apparatus main body 301 (front loading). The fed recording medium S is supplied onto the belt 205*a* of the electrostatic transfer belt unit 205 from the lower end side at the predetermined control timing by a registration roller pair 219. The recording medium S supplied onto the belt 205*a* is electrostatically attached to the belt 205*a*, and is sequentially fed, due to the rotation of the belt, to each of the transfer nip portions of the black cartridge Qk, the cyan cartridge Qc, the magenta cartridge Qm, and the yellow cartridge Qy. With this operation, unfixed full-color toner image of four color having k-color+c-color+m-color+y-color is synthesized and formed on the recording medium S.

Then, the recording medium S is separated from the surface of the belt 205*a*, and is introduced to a fixing portion 220. The fixing portion 220 performs fixing (fusion color-mixture fixing) of the toner image of a plurality of colors transferred onto the recording medium S. The fixing portion 220 includes a rotating heating roller 220*a* and a pressure roller 220*b* which is brought into pressure contact with the heating roller 220*a* so as to apply heat and pressure to the recording medium S. When passing the fixing portion 220, the recording medium S on which the toner image is formed is nipped and conveyed by the fixing roller pair 220*a* and 220*b*. Heat and pressure are applied by the fixing roller pair 220*a* and 220*b*. With this operation, the toner image of the plurality of colors is fixed onto the surface of the recording medium S. Then, the recording medium S gets out of the fixing portion 220, and is delivered as the full-color image formation product outside the apparatus main body from a delivery portion 224 by a delivery roller pair 223.

In a case of a monochrome image forming mode, the image formation using only the black cartridge Qk is performed.

(Cartridge Replacement System)

Each of the cartridges Q (Qy, Qm, Qc and Qk) may be replaced when the toner is consumed to finish lifetime thereof with the result of use by the user.

In the image forming apparatus of this embodiment, as to replacement of the cartridges Q, there is adopted, for the purpose of improving usability, a system in which the door 210 is opened and the cartridges Q are replaced by front access.

Figure 28:
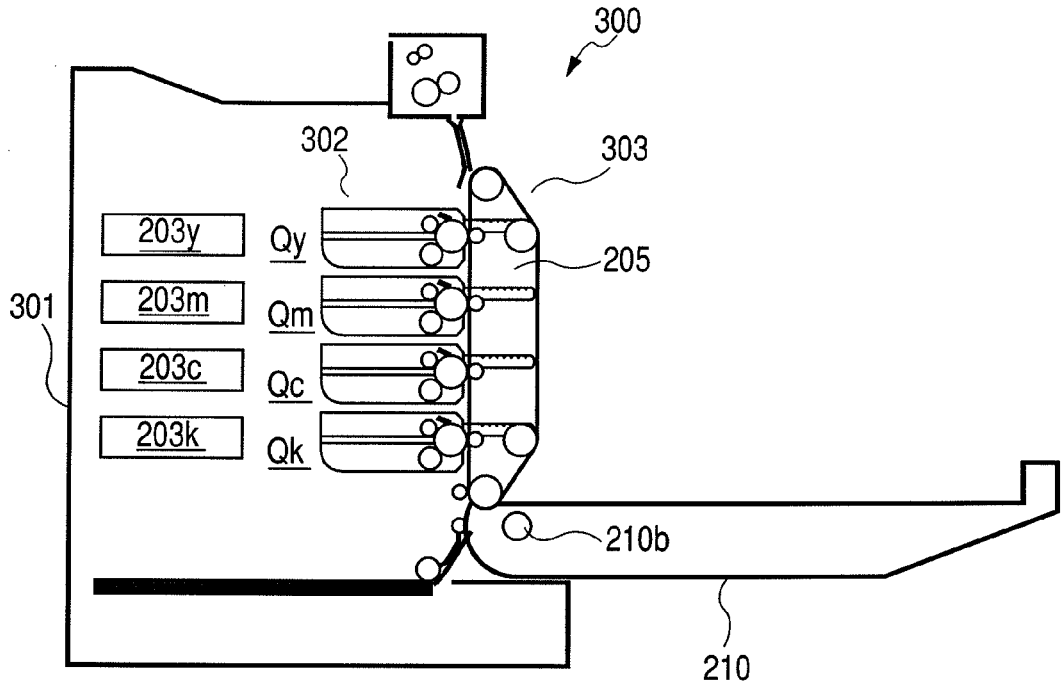
FIG. 28 is a view of the image forming apparatus with a door being opened.
Figure 29:
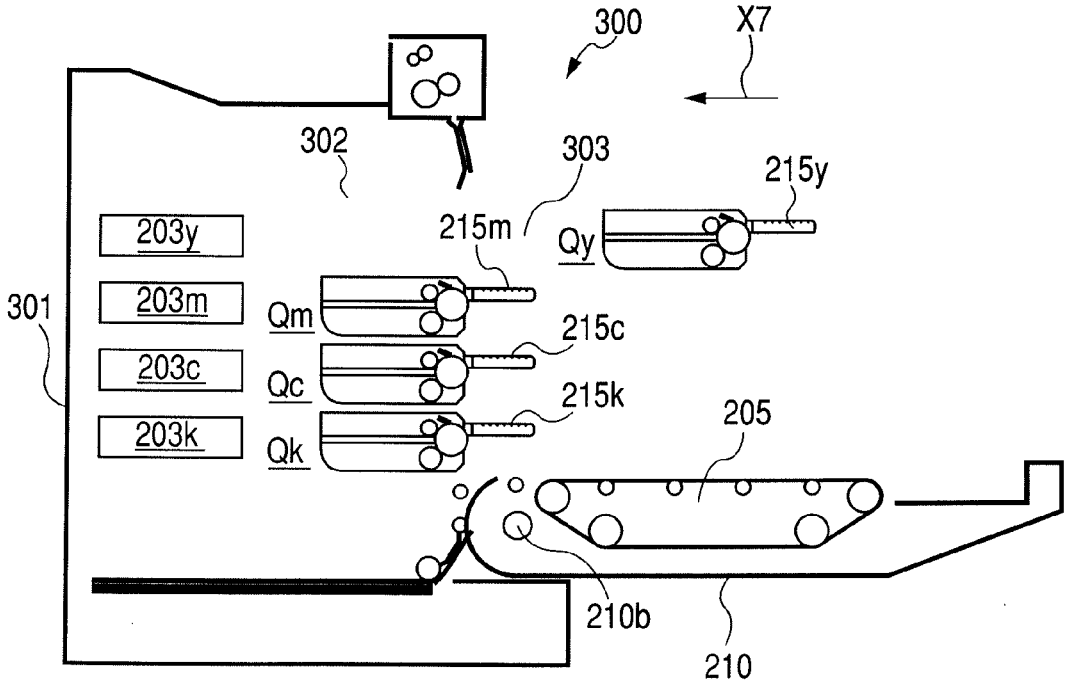
FIG. 29 is a view illustrating a state in which an electrostatic transfer belt unit is further retracted.

The door 210 rotates upright about a hinge portion 210*b*, and may cause an opening portion 303 of the apparatus main body 301 to be in the closed state as illustrated in FIG. 27. Further, the door 210 rotates about the hinge portion 210*b* so as to approximately horizontally lean toward the front of the apparatus main body 301, and may cause the opening portion 303 to be in the open state as illustrated in FIG. 28. When the door 210 is opened, the electrostatic transfer belt unit 205 is exposed in the opening portion 303. The unit 205 may also rotate about the hinge portion 210*b* so as to approximately horizontally lean toward the front of the apparatus main body 301. The unit 205 also rotates so as to lean as illustrated in FIG. 29. Thus, a cartridge mounting portion 302 inside the apparatus main body 301 and the front surface sides (outer surfaces) of the cartridges Qy, Qm, Qc, and Qk mounted to the cartridge mounting portion 302 are exposed. Note that, the electrostatic transfer belt unit 205 may be arranged on the back surface side of the door 210 integrally with the door 210, and may be formed so as to be openable and closable with respect to the apparatus main body 301 together with the door 210.

FIG. 29 illustrates how the cartridge Q is mounted to the cartridge mounting portion 302 of the apparatus main body 301. The user performs mounting operation of the cartridge Q to the apparatus main body 301 when newly using the apparatus main body or replacing the used cartridge to a new cartridge Q.

First, the user opens the door 210 (FIG. 28), and causes the electrostatic transfer belt unit 205 to retreat in the same direction as that of the door 210 (FIG. 29). Then, the user grips by hand gripping portions 214 and 215 protruding from outer surfaces of the cartridges Q, and mounts the cartridges to the apparatus main body 301 in the direction of the arrow X7. After that, the electrostatic transfer belt unit 205 is closed and the door 210 is further closed, whereby the image forming apparatus attains the state of being capable of image forming operation.

Figure 30:
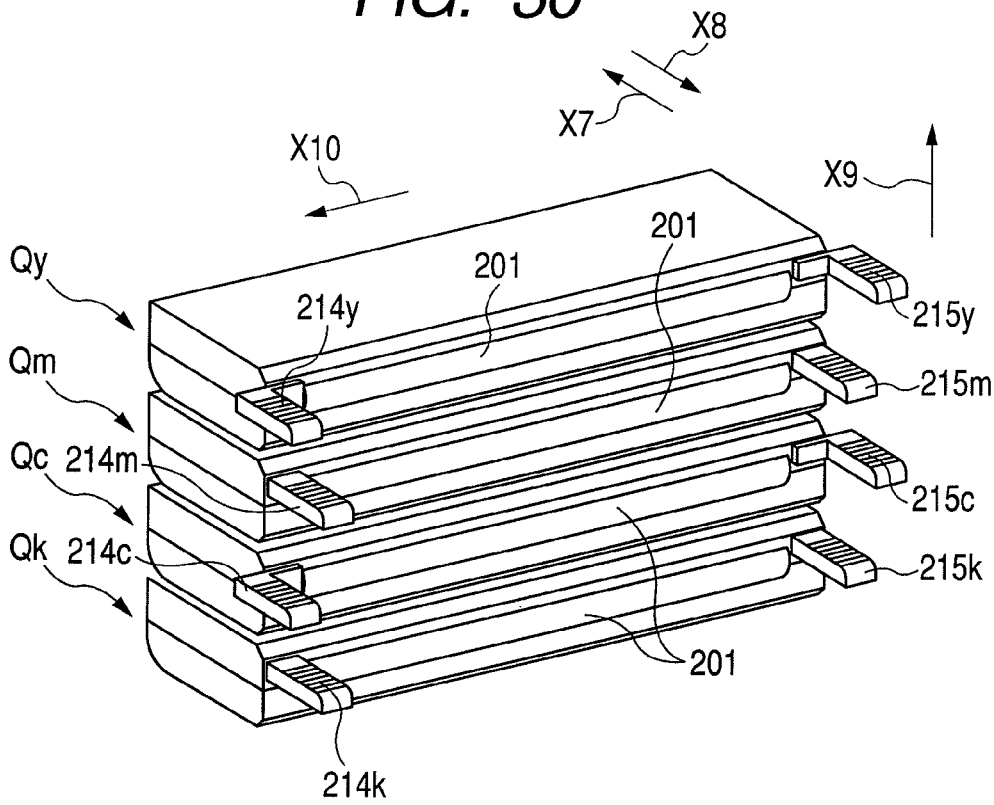
FIG. 30 is a perspective view of a plurality of cartridges viewed from a left-hand side.

FIG. 30 illustrates a state in which all the cartridges Q are completed to be mounted, and omits the structure of the apparatus main body. The cartridges Q are adjacently arranged in one direction (in this embodiment, vertical direction: arrow X9).

When the cartridge Q outlives its usefulness, the user performs detaching operation of the cartridge Q from the apparatus main body 301. The detaching operation is performed by the procedure reverse to the above-mentioned procedure for mounting. That is, the user opens the door 210 (FIG. 28), and then causes the electrostatic transfer belt unit 205 to retreat in the same direction as that of the door 210 (FIG. 29). Further, the user grips by hand the first gripping portion 214 (214*y*, 214*m*, 214*c* and 214*k*) and the second gripping portion 215 (215*y*, 215*m*, 215*c*, and 215*k*) of the cartridge Q to be replaced thereby to detach the cartridge outside the apparatus main body. In this case, the detaching direction (arrow X8) of the cartridge Q is opposite to the mounting direction (arrow X7), and the cartridge Q is detached from the apparatus main body 301 in the approximately horizontal direction. The mounting and detaching direction of the cartridge Q indicates the above-mentioned mounting direction and detaching direction.

As described above, each of the cartridges Q is provided with the first gripping portion 214 and the second gripping portion 215, and hence the user may easily perform mounting and detaching operation with respect to the apparatus main body by gripping the gripping portions 214 and 215 by hand.

(Example of Cartridge Gripping Portion)

Figure 31:
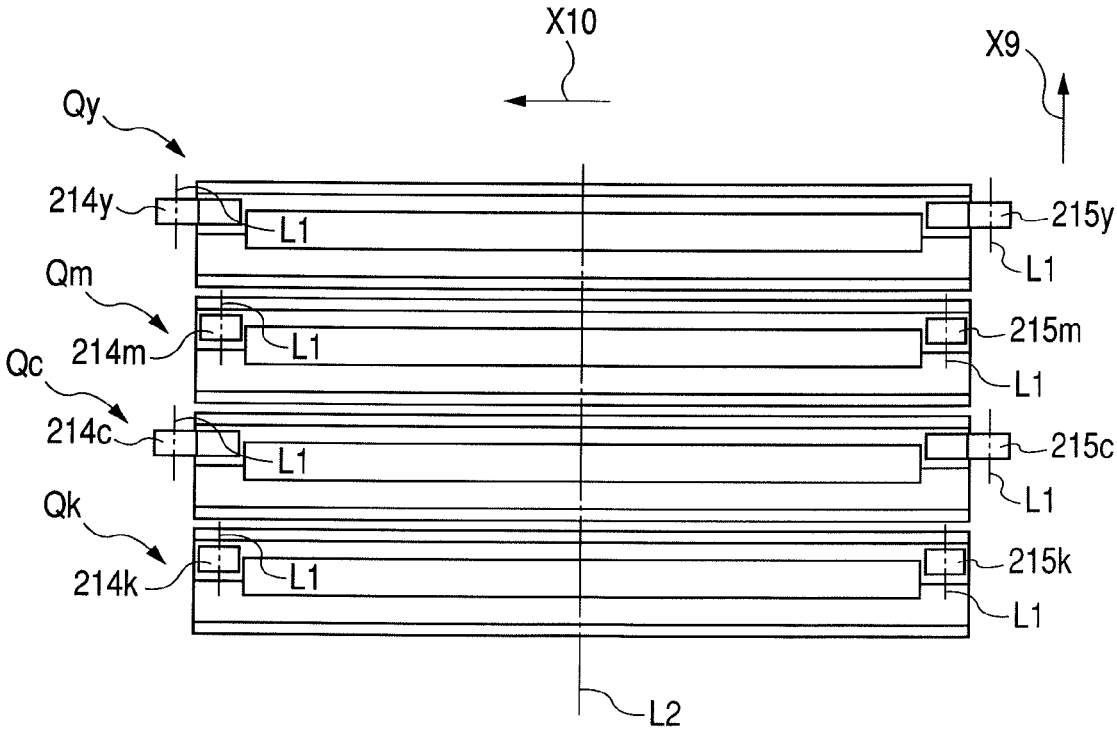
FIG. 31 is a view of cartridge gripping portions of a structural example.

FIG. 31 is a front view of the cartridges Q taken in the mounting direction. The user grips by both hands the first gripping portion 214 and the second gripping portion 215 respectively provided on the left-hand and right-hand sides of each of the cartridges Q, and performs mounting and detaching operation of the cartridge Q. The user may hold the cartridge Q by both hands, and hence the user may easily hold the same in a stable manner when compared to the case of operation with one hand.

As illustrated in FIG. 31, the first gripping portion 214 and the second gripping portion 215 of each of the cartridges Q are disposed out of line with the gripping portions of the cartridges adjacent to each other. That is, the first gripping portion 214*y* provided to the yellow cartridge Qy is disposed out of line with the first gripping portion 214*m* provided to the adjacent magenta cartridge Qm. Similarly, the first gripping portion 214*c* provided to the cyan cartridge Qc is disposed out of line with the first gripping portion 214*m* and the first gripping portion 214*k* respectively provided to the magenta cartridge Qm and the black cartridge Qk adjacent to the cyan cartridge Qc. The first gripping portion 214*k* provided to the black cartridge Qk is disposed out of line with the first gripping portion 214*c* provided to the adjacent cyan cartridge Qc.

Similarly, the second gripping portion 215 of each of the cartridges is disposed out of line with the gripping portions of the adjacent cartridges.

The direction in which the gripping portions 214 and 215 are disposed out of line with each other (arrow X10) is orthogonal to the above-mentioned one direction in which the plurality of the cartridges Q are adjacent to each other (arrow X9), and to the mounting and detaching direction of the cartridges (arrows X7 and X8).

Each of the gripping portions 214 and 215 is disposed out of line with the gripping portions of the adjacent cartridges in the direction of the arrow X10. Thus, when the user grips the gripping portions 214 and 215, it is unlikely that the gripping portions of the adjacent cartridges become obstacles, whereby it is possible to easily hold the gripping portions.

Further, a longitudinal center line L1, which is the lateral direction of each of the gripping portions 214 and 215, does not overlap the adjacent gripping portions. Therefore, when it is considered that the user grips the gripping portions 214 and 215 at substantially the center thereof, the user grips the gripping portions 214 and 215 more easily when compared to the case in which the gripping portions 214 and 215 are solely disposed out of line with each other.

Further, as illustrated in FIG. 31, each of the gripping portions 214 and 215 is provided so as to put a center line L2 therebetween, which is positioned at the center in the longitudinal direction which is the lateral direction of each of the cartridges Q. Therefore, when assuming that a center of gravity of each of the cartridges Q is in the vicinity of approximately the longitudinal center thereof, the user may grip the cartridge Q on both sides thereof putting the center of gravity therebetween, whereby it is possible to stably hold the cartridge Q.

Further, in this example, in the X10 direction, each of the gripping portions 214 and 215 does not overlap the gripping portions of the adjacent cartridges. Therefore, the user may further grip the gripping portions 214 and 215 easily. That is, the spaces in the X9 direction are widen in the X10 direction, and hence it is easy to hold the cartridges.

As described above, in the third embodiment, there is described the example in which the cartridges Q are mounted to the image forming apparatus having the longitudinal tandem structure. In the third embodiment, as the cartridge Q, there is exemplified the process cartridge which integrally contains the photosensitive drum, the developing roller, and the developer. However, the form of the cartridge is not limited thereto, and a developing cartridge which integrates the developing roller and the developer, a toner cartridge which integrates the developer and a container therefor, or the like is also applicable as the form of the cartridge.

Further, while in this embodiment one example is described as the gripping portions, the structure of the structural examples 4 (FIG. 9), 5 (FIG. 10), 7 (FIG. 12), 8 (FIG. 13), etc. described in the first embodiment may be also used.

As described above, according to the first to third embodiments, even when the distance between the cartridges mounted to the apparatus main body becomes small in accordance with downsizing of the image forming apparatus, the user may easily hold the gripping portions of the cartridges. In other words, by applying the structure of this embodiment, it is possible to achieve downsizing of the image forming apparatus without deteriorating operability for the user.

According to the embodiments described above, it is possible to provide a color electrophotographic image forming apparatus including the plurality of cartridges adjacently mounted to the apparatus main body, in which the gripping portions provided to each of the cartridges are easily gripped by the user.

According to the embodiments described above, it is possible to provide a color electrophotographic image forming apparatus including the plurality of cartridges adjacently mounted to the apparatus main body, in which the operability when the user mounts and detaches the cartridge to and from the apparatus main body is improved.

According to the embodiments described above, it is possible to provide the color electrophotographic image forming apparatus in which the mounting and detaching operability of the cartridge is improved even when the user may not insert his/her hand for gripping the cartridge because the adjacent cartridges have narrow intervals therebetween in a state of being mounted to the apparatus main body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions This application claims the benefit of Japanese Patent Application No. 2008-307380, filed Dec. 2, 2008, which is hereby incorporated by reference herein in its entirety.

What is claimed is:

1. A color electrophotographic image forming apparatus having an apparatus main body to which a plurality of cartridges are detachably mounted adjacently in one direction for forming a color image on a recording medium, wherein each of the plurality of cartridges has a gripping portion disposed on a rear end side of each of the plurality of cartridges in a mounting direction in which each of the plurality of cartridges is mounted to the apparatus main body, the gripping portion protruding from the rear end side to an upstream side, wherein, when each of the plurality of cartridges is mounted to and detached from the apparatus main body, a user grips the gripping portion, and wherein, in a state in which the plurality of cartridges are mounted to the apparatus main body, at least one gripping portion is offset from a gripping portion of an adjacent cartridge in a direction orthogonal to the mounting direction and a direction orthogonal to the one direction as viewed along the one direction wherein each of the plurality of cartridges mounted to the apparatus main body comprises a first gripping portion and a second gripping portion, and wherein, in the direction orthogonal to the mounting direction and the direction orthogonal to the one direction as viewed along the one direction, a distance from a center of a corresponding cartridge to the first gripping portion is equal to a distance from the center thereof to the second gripping portion, and a distance from a center of another cartridge adjacent to the corresponding cartridge to a first gripping portion is equal to a distance from the center thereof to a second gripping portion, and the distances of the corresponding cartridge differ from the distances of the another cartridge adjacent to the corresponding cartridge.

2. A color electrophotographic image forming apparatus according to claim 1, wherein, in the direction orthogonal to the mounting direction and the direction orthogonal to the one direction as viewed along the one direction, the gripping portion is provided in a position so that the gripping portion does not overlap the gripping portion of the adjacent cartridge.

3. A color electrophotographic image forming apparatus according to claim 2, wherein the gripping portion is movable between a protruded position being protruded from an outer surface on the rear end side to the upstream side of each of the plurality of cartridges and a retracted position being positioned at an opposite side to the upstream side than the protruded position, and wherein the gripping portion is gripped by the user in a state in which the gripping portion is in the protruded position.

4. A color electrophotographic image forming apparatus according to claim 3, wherein the apparatus main body comprises an opening portion for mounting and detaching the plurality of cartridges and an openable and closable member for opening and closing the opening portion, and wherein an operation of closing the openable and closable member causes an abutment portion provided on the openable and closable member to abut on a part of the gripping portion so that the gripping portion is moved from the protruded position to the retracted position.

5. A color electrophotographic image forming apparatus according to claim 3, wherein the gripping portion is rotated about a rotation center to move from the protruded position to the retracted position, and wherein a moving direction in which an openable and closable member of the apparatus main body is closed is the same as a moving direction in which the gripping portion is moved from the protruded position to the retracted position.

6. A color electrophotographic image forming apparatus according to claim 5, wherein an operation of closing the openable and closable member causes an abutment portion provided on the openable and closable member to abut on a part of the gripping portion so that the gripping portion is upward rotated about the rotation center to move from the protruded position to the retracted position, and when the openable and closable member is opened, the gripping portion is moved from the retracted position to the protruded position with an aid of a gravitational force of the gripping portion.

7. A color electrophotographic image forming apparatus according to claim 6, wherein in a state in which the gripping portion is positioned in the retracted position, the gripping portion is positioned in a space between the openable and closable member and a corresponding cartridge of the plurality of cartridges.

8. A color electrophotographic image forming apparatus according to claim 7, wherein in a state in which the gripping portion is positioned in the retracted position, the gripping portion overlaps the adjacent cartridge when seen from the mounting direction.

9. A color electrophotographic image forming apparatus according to claim 2, wherein the gripping portion is movable between a protruded position being protruded from an outer surface on the rear end side to the upstream side of each of the plurality of cartridges and a retracted position being positioned at an opposite side to the upstream side than the protruded position, and wherein, when seen from the direction orthogonal to the one direction and the direction orthogonal to the mounting direction of the plurality of cartridges, at least a part of the gripping portion overlaps the griping portion of the adjacent cartridge at the retracted position.

10. A color electrophotographic image forming apparatus according to claim 9, wherein the apparatus main body comprises an opening portion for mounting and detaching the plurality of cartridges and an openable and closable member for opening and closing the opening portion, and wherein an operation of closing the openable and closable member causes an abutment portion provided on the openable and closable member to abut on a part of the gripping portion so that the gripping portion is moved from the protruded position to the retracted position.

11. A color electrophotographic image forming apparatus according to claim 10, wherein each of the plurality of cartridges contains a different color developer from cartridge to cartridge, and wherein the gripping portion is formed in the same color as or a similar color to a developer contained in a corresponding cartridge on which the gripping portion is provided.

12. A color electrophotographic image forming apparatus according to claim 1, wherein the plurality of cartridges are mounted to the apparatus main body in a horizontal direction or a vertical direction.

* * * * *